US011664145B2

(12) United States Patent
Oki

(10) Patent No.: US 11,664,145 B2
(45) Date of Patent: May 30, 2023

(54) INDUCTOR

(71) Applicant: SUMIDA CORPORATION, Tokyo (JP)

(72) Inventor: Juichi Oki, Natori (JP)

(73) Assignee: SUMIDA CORPORATION

( * ) Notice: Subject to any disclaimer, the term of this patent is extended or adjusted under 35 U.S.C. 154(b) by 375 days.

(21) Appl. No.: 16/862,716

(22) Filed: Apr. 30, 2020

(65) Prior Publication Data

US 2020/0388431 A1 Dec. 10, 2020

(30) Foreign Application Priority Data

Jun. 4, 2019 (JP) ..... JP2019-104823

(51) Int. Cl.

| | |
|---|---|
| ***H01F 27/24*** | (2006.01) |
| ***H01F 17/04*** | (2006.01) |
| ***H01F 27/06*** | (2006.01) |
| ***H01F 27/29*** | (2006.01) |

(52) U.S. Cl.

CPC ..... *H01F 27/24* (2013.01); *H01F 17/04* (2013.01); *H01F 27/06* (2013.01); *H01F 27/29* (2013.01)

(58) Field of Classification Search

CPC ..... H01F 27/29; H01F 27/32; H01F 41/12; H01F 27/06; H01F 27/24; H01F 17/04

See application file for complete search history.

(56) References Cited

U.S. PATENT DOCUMENTS

2003/0227366 A1 12/2003 Lin
2006/0049906 A1* 3/2006 Liu ..... H01F 27/027 336/200
2006/0089022 A1 4/2006 Sano
(Continued)

FOREIGN PATENT DOCUMENTS

EP 3067902 A2 9/2016
JP 2000-091125 A 3/2000
(Continued)

OTHER PUBLICATIONS

Extended European Search Report for Patent Application No. EP 20174354.9 dated Jun. 16, 2020 (9 pages).
(Continued)

*Primary Examiner* — Michael P McFadden
(74) *Attorney, Agent, or Firm* — Harness, Dickey & Pierce, P.L.C.

(57) ABSTRACT

An inductor includes a magnetic core and a conductor member. The conductor member is configured with: an insertion part that is inserted into the magnetic core; first and second outer surface arrangement parts that are directly or indirectly connected to ends of the insertion part and are arranged along first and second outer surfaces of the magnetic core, respectively; and first and second terminal parts that are connected to the first and second outer surface arrangement parts, respectively. The insertion part includes an insertion first sub part and an insertion second sub part that is stacked on the insertion first sub part. A sum of the thicknesses of the insertion first and second sub parts is larger than a thickness of the first outer surface arrangement part and larger than a thickness of the second outer surface arrangement part.

17 Claims, 13 Drawing Sheets

(56) References Cited

U.S. PATENT DOCUMENTS

2011/0148559 A1* 6/2011 Ikriannikov ..... H01F 3/08 336/192
2014/0266539 A1* 9/2014 Krishnamoorthy ..... H01F 27/29 336/221
2014/0266555 A1* 9/2014 Krishnamoorthy ..... H01F 3/10 336/216
2014/0347155 A1* 11/2014 Nomura ..... H01F 27/2847 336/173
2015/0170820 A1* 6/2015 Kadir ..... H01F 27/306 29/606
2015/0325361 A1* 11/2015 Zajc ..... H01F 27/24 29/605
2016/0005528 A1* 1/2016 Yan ..... H01F 27/292 336/192
2016/0276087 A1* 9/2016 Yan ..... H01F 27/306
2017/0047155 A1* 2/2017 Yao ..... H01F 17/04
2017/0178795 A1* 6/2017 Todorov ..... H05K 3/308
2020/0043643 A1* 2/2020 Yan ..... H01F 3/14

FOREIGN PATENT DOCUMENTS

JP 2000-164431 A 6/2000
JP 2003-309024 A 10/2003
JP 2005-310864 A 11/2005
JP 2006-120887 A 5/2006
JP 2013-016727 A 1/2013
WO 2014/143418 A1 9/2014

OTHER PUBLICATIONS

Office Action issued in the corresponding Japanese Patent Application No. 2019-104823; dated Mar. 22, 2023 (total 8 pages).

* cited by examiner

INDUCTOR

CROSS-REFERENCE TO RELATED APPLICATIONS

This application claims priority to Japanese Patent Application No. 2019-104823 filed Jun. 4, 2019, which is hereby expressly incorporated by reference herein in its entirety.

BACKGROUND

1. Technical Field

The present invention relates to an inductor.

2. Related Art

A known inductor is described in Japanese Patent Publication Number 2000-164431.

The inductor that is described in Japanese Patent Publication Number 2000-164431 is configured with a magnetic core and a conductor member (a plate-like or malleable flat type copper wire (rectangular copper wire) or a punched copper plate). Specifically, the magnetic core is configured by assembling an I-shaped (I-type) first core member and a U-shaped (U-type) second core member. The conductor member is assembled into the magnetic core in a state in which both ends in a longitudinal direction are exposed from the magnetic core.

According to the investigation of the inventor of the present invention, with respect to the inductor that is described in Japanese Patent Publication Number 2000-164431, there is room for improving the reduction of the DC (direct current) resistance of the conductor member.

SUMMARY

The present invention attempts to solve the above problems. An object of the present invention is to provide an inductor that has a configuration in which a DC resistance of a conductor member (conductor) can be sufficiently reduced.

According to one aspect of the present invention, an inductor includes a magnetic core and a conductor member. Specifically, the conductor member is configured with: an insertion part that is inserted into the magnetic core; a first outer surface arrangement part that is directly or indirectly connected to one end of the insertion part and that is arranged along a first outer surface of the magnetic core; a second outer surface arrangement part that is directly or indirectly connected to the other end of the insertion part and that is arranged along a second outer surface of the magnetic core; a first terminal part that is connected to the first outer surface arrangement part; and a second terminal part that is connected to the second outer surface arrangement part. The insertion part includes an insertion first sub part and an insertion second sub part that is stacked on the insertion first sub part. A sum of the thicknesses of the insertion first and second sub parts is larger than each of a thickness of the first outer surface arrangement part and a thickness of the second outer surface arrangement part.

According to the present invention, the inductor that has a configuration in which a DC resistance of a conductor member (conductor) can be sufficiently reduced can be provided.

BRIEF DESCRIPTION OF THE DRAWINGS

FIG. 3A is a front view that shows the inductor. Further, FIG. 3B is a partial enlarged view that shows the inductor shown in FIG. 3A.

DESCRIPTION OF EXEMPLARY EMBODIMENTS

Figure 1:
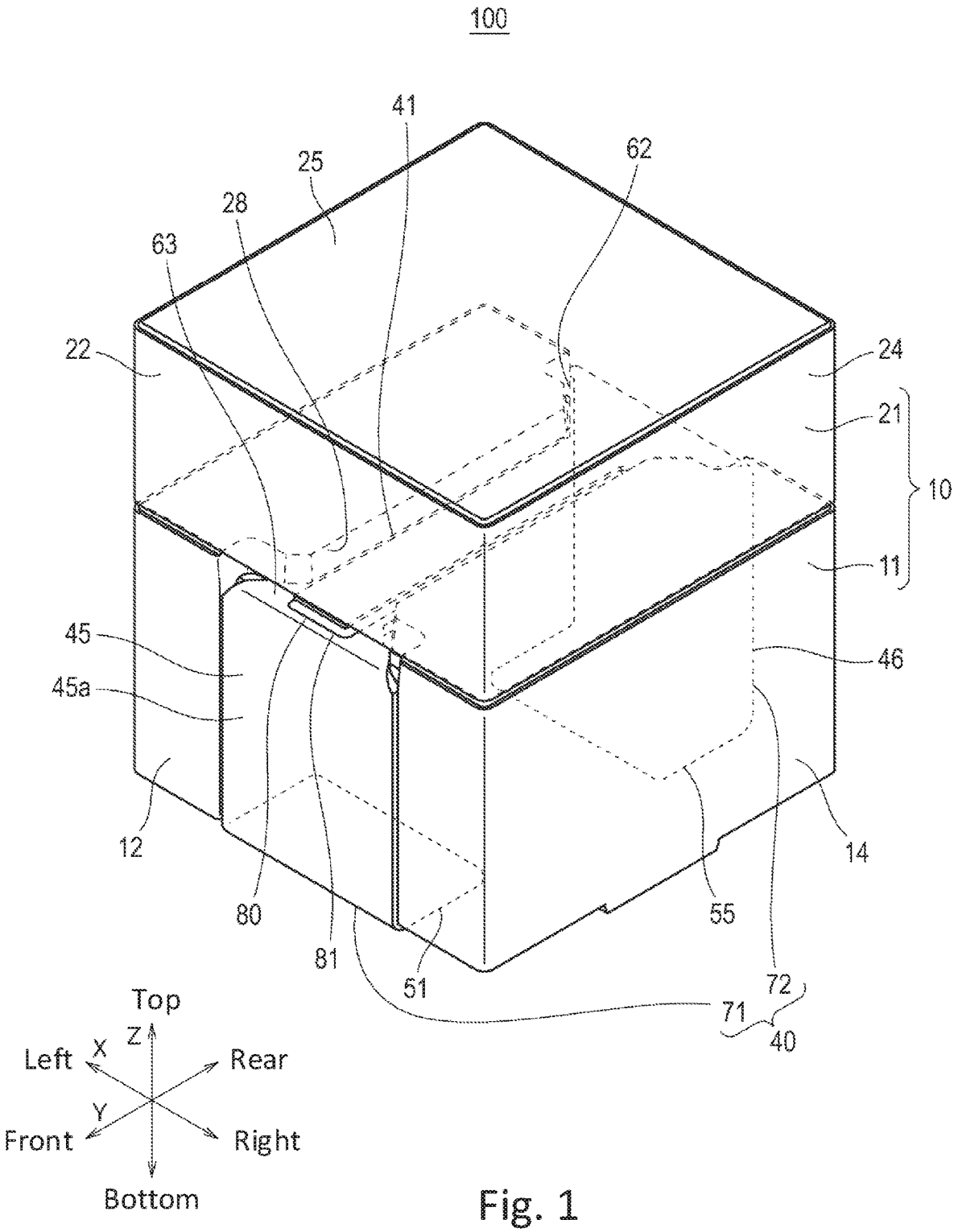
FIG. 1 is a perspective view that shows an inductor according to a first embodiment of the present invention.

As discussed below, embodiments according to the present invention will be explained with reference to FIGS. 1-13. In regards to the drawings, redundant explanations with respect to the same configurations are omitted but the same reference numerals are used for labeling.

First Embodiment

First, a first embodiment according to the present invention will be explained with reference to FIGS. 1-7 below. As shown in any of FIGS. 1-7, an inductor 100 according to the present embodiment has a magnetic core 10 (for instance, shown in FIG. 1) and a conductor member (conductor) 40 (for instance, shown in FIG. 1).

Figure 2:
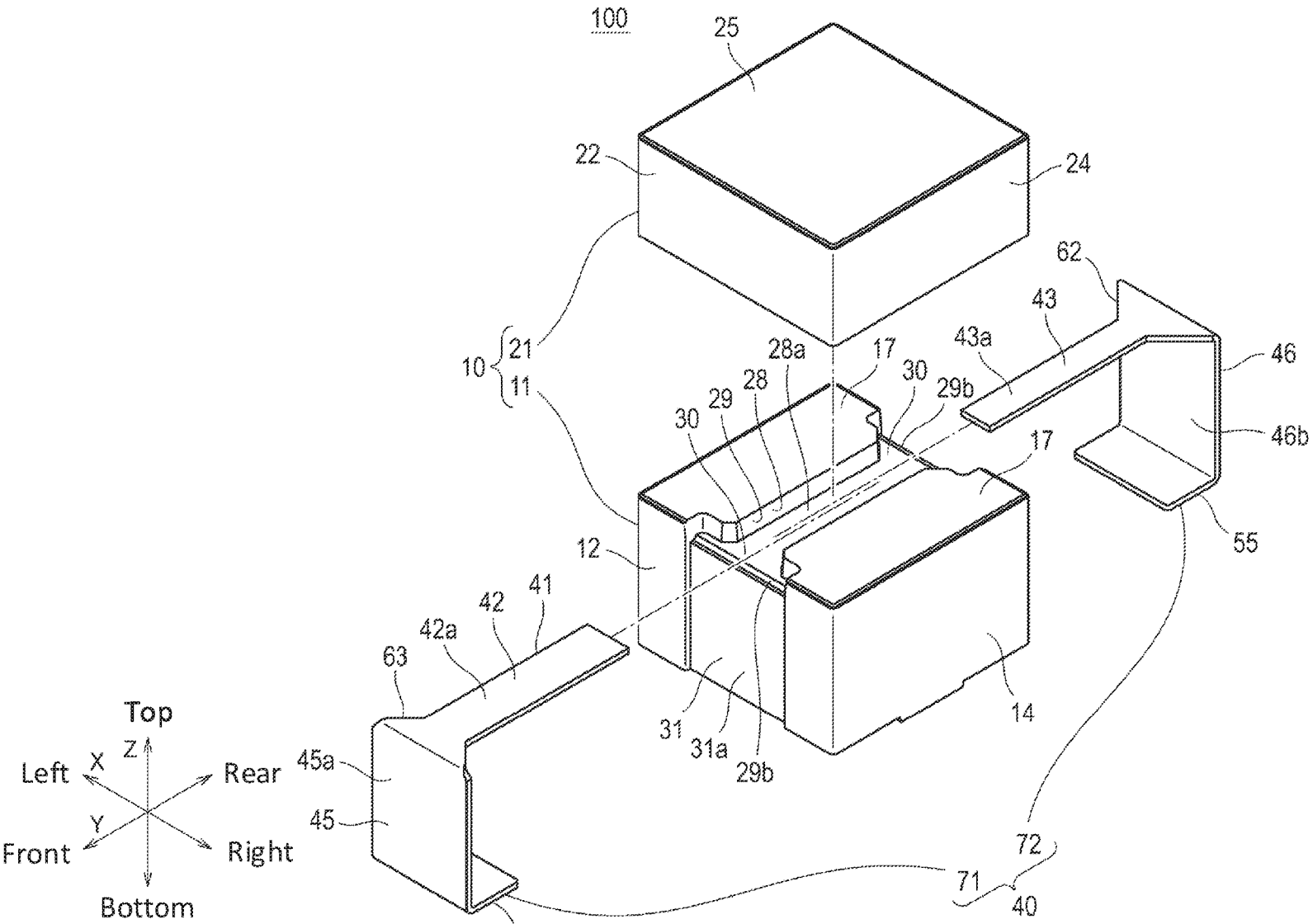
FIG. 2 is an exploded perspective view that shows the inductor according to the first embodiment of the present invention.

The conductor member 40 includes an insertion part 41 (for instance, shown in FIG. 1), a first outer surface arrangement part 45 (for instance, shown in FIG. 2), a second outer surface arrangement part 46 (for instance, shown in FIG. 2), a first terminal part 51 (for instance, shown in FIG. 2), and a second terminal part 55 (for instance, shown in FIG. 2). Specifically, the insertion part 41 is inserted into the magnetic core 10. The first outer surface arrangement part 45 is indirectly or directly connected to one end side of the insertion part 41, and at the same time, is arranged along an outer surface (first outer surface) of the magnetic core 10. The second outer surface arrangement part 46 is indirectly or directly connected to the other end side of the insertion part 41, and at the same time, is arranged along the outer surface (second outer surface) of the magnetic core 10. The first terminal part 51 is connected to the first outer surface arrangement part 45. The second terminal part 55 is connected to the second outer surface arrangement part 46.

The insertion part 41 is configured with an insertion first sub part (first part) 42 (for instance, shown in FIG. 2) and an insertion second sub part (second part) 43 (for instance, shown in FIG. 2). Specifically, the insertion second sub part 43 is arranged so as to be stacked on the insertion first sub part 42 (for instance, shown in FIGS. 4A-4B). A sum of the thicknesses (a total thickness corresponding to a thickness T1 shown in FIG. 4A) of the insertion first sub part 42 and the insertion second sub part 43 of the insertion part 41 is larger than each of the thicknesses (corresponding to thicknesses T2 and T3 shown in FIG. 4A) of the first outer surface arrangement part 45 and the second outer surface arrangement part 46 (T1>T2 and T1>T3).

According to the present embodiment, because the insertion part 41 of the conductor member 40 is configured with the insertion first sub part 42 and the insertion second sub part 43 that is stacked on the insertion first sub part 42, the thickness of the insertion part 41 can be sufficiently secured. As a result, a DC resistance of the conductor member 40 of the inductor 100 can be sufficiently reduced.

Further, because of the characteristic of the inductor 100, it is preferred that a width dimension W1 (a width dimension W1 shown in FIG. 5) of the insertion part 41 is within a certain range with reference to width dimensions W4 and W5 (width dimensions W4 and W5 shown in FIG. 5) of both sides of the insertion part 41 of the magnetic core 10. In other words, because of the characteristic of the inductor 100, the width dimension of the insertion part 41 has a certain degree of a restriction. With respect to the circumstance explained above, according to the present embodiment, because the insertion part 41 is configured with the insertion first sub part 42 and the insertion second sub part 43 that are stacked on each other, the DC resistance of the insertion part 41 can be reduced while suppressing the increase in size of the width dimension of the insertion part 41. At the same time, the DC resistance of the insertion part 41 can be easily set to a desired value.

In the following explanations, a vertical direction (an up-and-down direction) is referred to as "a Z-direction." A bottom (below, down, under, or downward) corresponds to a side on which the first terminal part 51 and the second terminal part 55 are arranged. That is, the bottom corresponds to a side of a mounting surface of the inductor 100. On the other hand, an opposite side of the bottom is referred to as a top (above, up, over, or upward). However, a positional relationship (in particular, a vertical (up-and-down or Z-direction) positional relationship) of each part in manufacturing or using (operating) the inductor 100 is not limited to the positional relationship that is explained in the specification.

A longitudinal direction of the insertion part 41 extends in a direction that is orthogonal to the Z-direction. The longitudinal direction of the insertion part 41 is referred to as "a Y-direction." Further, one side of the Y-direction is referred to as "a front (ahead or forward)" and the other side of the Y-direction is referred to as "a rear (back or backward)."

Further, a direction that is orthogonal to both of the Y-direction and the Z-direction is referred to as "an X-direction." One side of the X-direction is referred to as "left (left side)" and the other side of the X-direction is referred to as "right (right side)." These directions (top, bottom, front, rear, left, and right) explained above are shown in each drawing.

Further, in the Y-direction (in the longitudinal direction of the insertion part 41), a central side of the insertion part 41 is referred to as "inside or interior (inner side)" and opposite sides of the inside are referred to as "outside or exterior (outer side)." Similarly, in the X-direction (in a short (width or lateral) direction of the insertion part 41), a central side of the insertion part 41 is referred to as "inside or interior (inner side)" and opposite sides of the inside are referred to as "outside or exterior (outer side)."

Further, an orientation (direction) that is orthogonal to the Z-direction is referred to as "a horizontality (a horizontal direction)" and an orientation (direction) that is along the Z-direction is referred to as "a vertical (a vertical direction)."

Further, unless otherwise noted, a positional relationship of each part of the inductor 100 corresponds to a positional relationship in a state in which the inductor 100 has been manufactured by assembling each part of the inductor 100.

As shown in FIGS. 1 and 2, in the present embodiment, for instance, the magnetic core 10 is formed in a substantially cube shape. For instance, the magnetic core 10 is formed to have bilateral (left-right) symmetry, and at the same time, a front-rear symmetry. Top and bottom (upper and lower) surfaces of the magnetic core 10 are respectively horizontally arranged (and parallel to one another). A front surface faces a front side and a rear surface faces a rear side. Further, left and right side surfaces face left and right sides, respectively.

In the present embodiment, the magnetic core 10 is configured by stacking and assembling two upper and lower members, i.e., a first core member 11 that is located at a lower side and a second core member 21 that is located at an upper side. The first core member 11 and the second core member 21 are respectively formed in a substantially rectangular parallelepiped shape. The first core member 11 has a front surface 12, a rear surface 13, a pair of left and right side surfaces 14, a top surface 15, and a bottom surface 16. Specifically, the front surface 12 faces the front side. The rear surface 13 faces the rear side. The pair of left and right side surfaces 14 face the right and left sides, respectively. The top surface 15 faces the upper side. The bottom surface 16 faces the lower side. Similarly, the second core member 21 has a front surface 22, a rear surface 23, a pair of left and right side surfaces 24, a top surface 25, and a bottom surface 26. Specifically, the front surface 22 faces the front side. The rear surface 23 faces the rear side. The pair of left and right side surfaces 24 face the right and left sides, respectively. The top surface 25 faces the upper side. The bottom surface 26 faces the lower side. The bottom surface 26 of the second core member 21 is, on the whole, formed to be flat and is horizontally arranged.

Each of the first core member 11 and the second core member 21 is integrally formed by, for instance, a magnetic material such as ferrite.

It is preferred that a lateral (left-right) width dimension along the X-direction of the first core member 11 is equal to a lateral (left-right) width dimension along the X-direction of the second core member 12. In addition, it is preferred that a front-rear width dimension along the Y-direction of the first core member 11 is equal to a front-rear width dimension along the Y-direction of the second core member 12. In the present embodiment, a vertical dimension along the Z-direction (height) of the first core member 11 is larger than a vertical dimension along the Z-direction (height) of the second core member 12.

The front surface 12 of the first core member 11 and the front surface 22 of the second core member 21 are mutually arranged on the same plane, and at the same time, the rear surface 13 of the first core member 11 and the rear surface 23 of the second core member 21 are mutually arranged on the same plane. The left side surface 14 of the first core member 11 and the left side surface 24 of the second core member 21 are mutually arranged on the same plane, and at the same time, the right surface 14 of the first core member 11 and the right surface 24 of the second core member 21 are mutually arranged on the same plane.

Therefore, a front surface of the magnetic core 10 is configured with the front surfaces 12 and 22. A rear surface of the magnetic core 10 is configured with the rear surfaces 13 and 23. A left side surface of the magnetic core 10 is configured with the left side surfaces 14 and 24. Further, a right side surface of the magnetic core 10 is configured with the right side surfaces 14 and 24.

Figure 5:
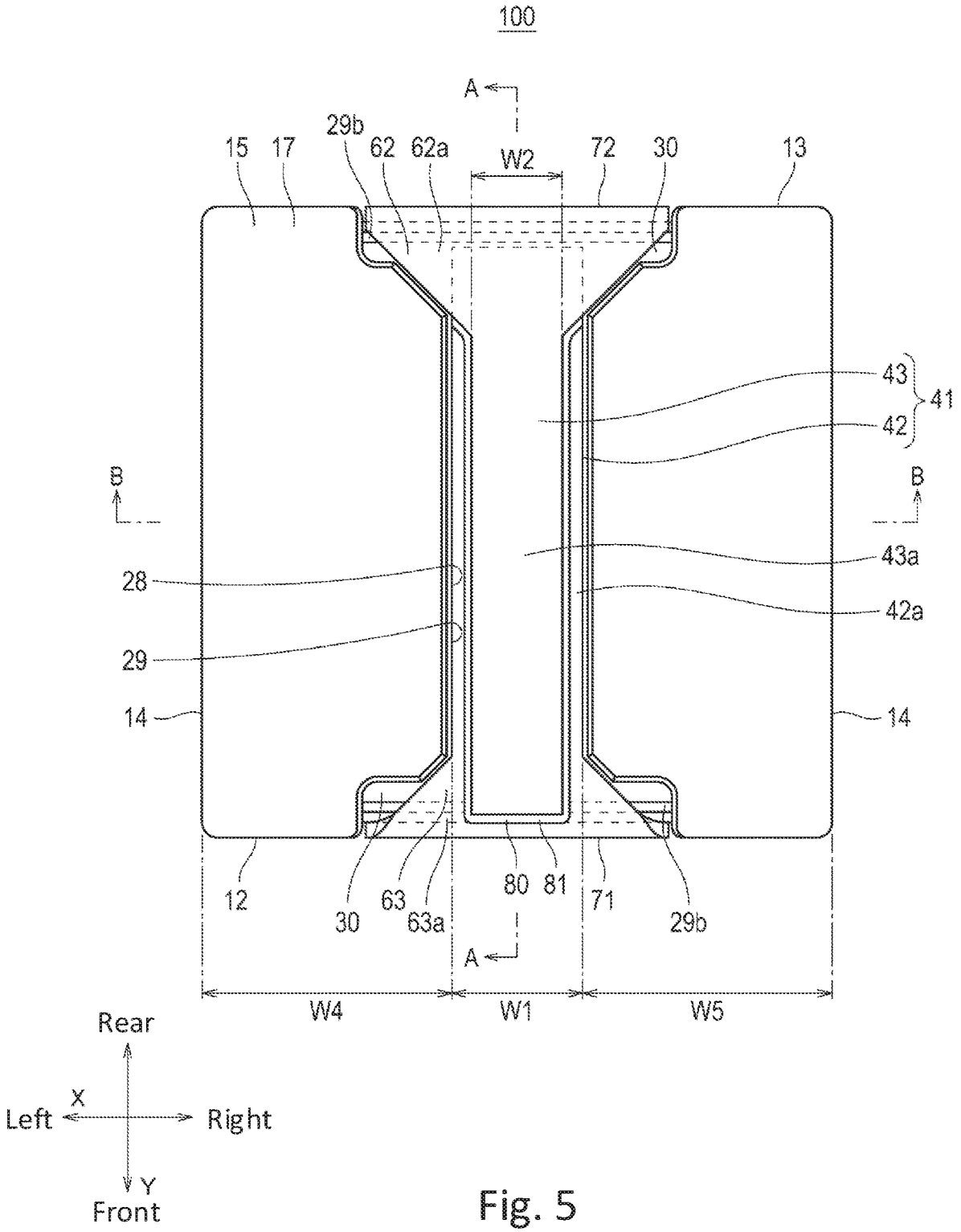
FIG. 5 is a plan view that shows the inductor according to the first embodiment of the present invention (however, an illustration that shows a second core member is omitted).
Figure 6:
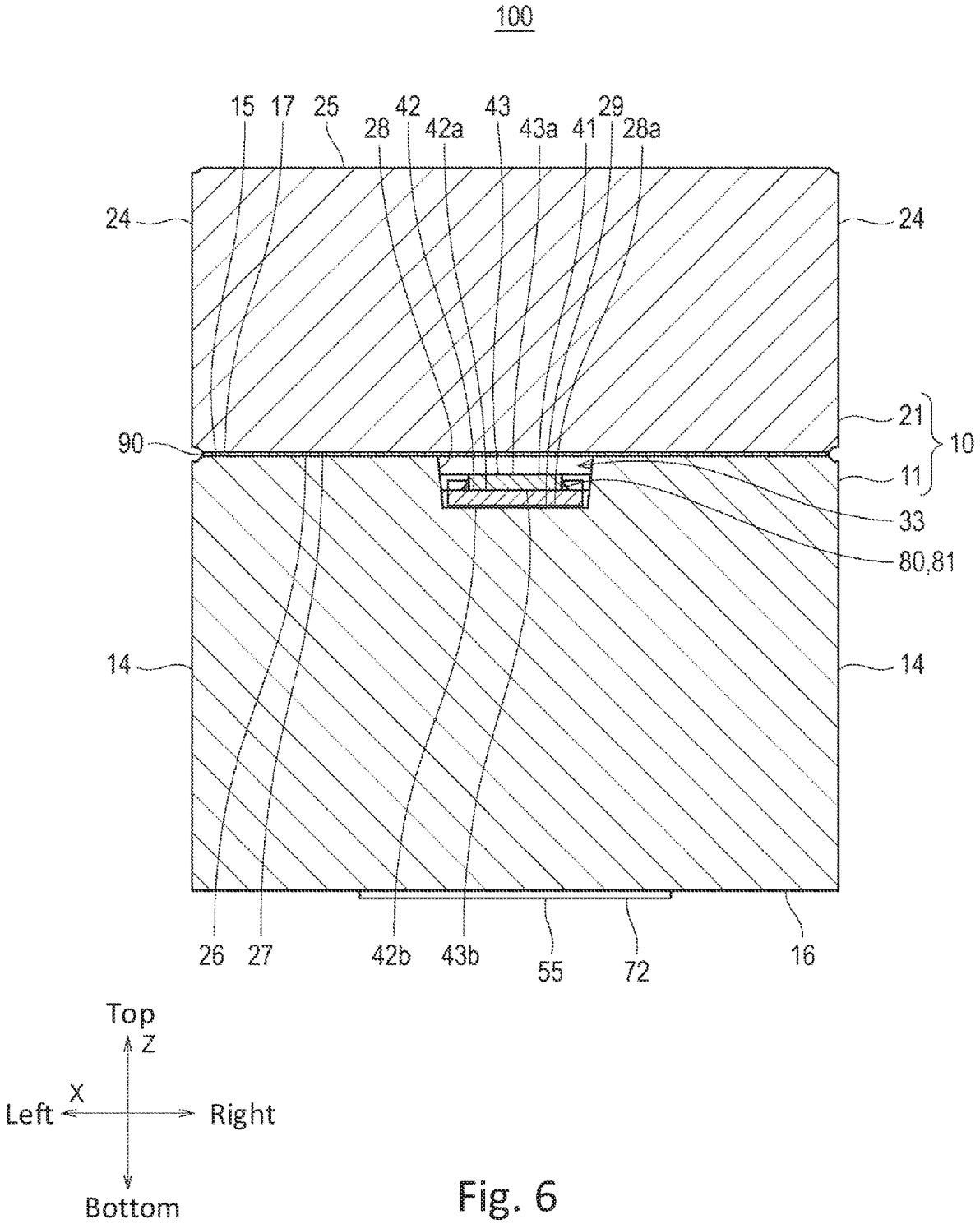
FIG. 6 is a front cross-sectional view (a cross-sectional view along the B-B line shown in FIG. 5) that shows the inductor according to the first embodiment of the present invention.
Figure 7:
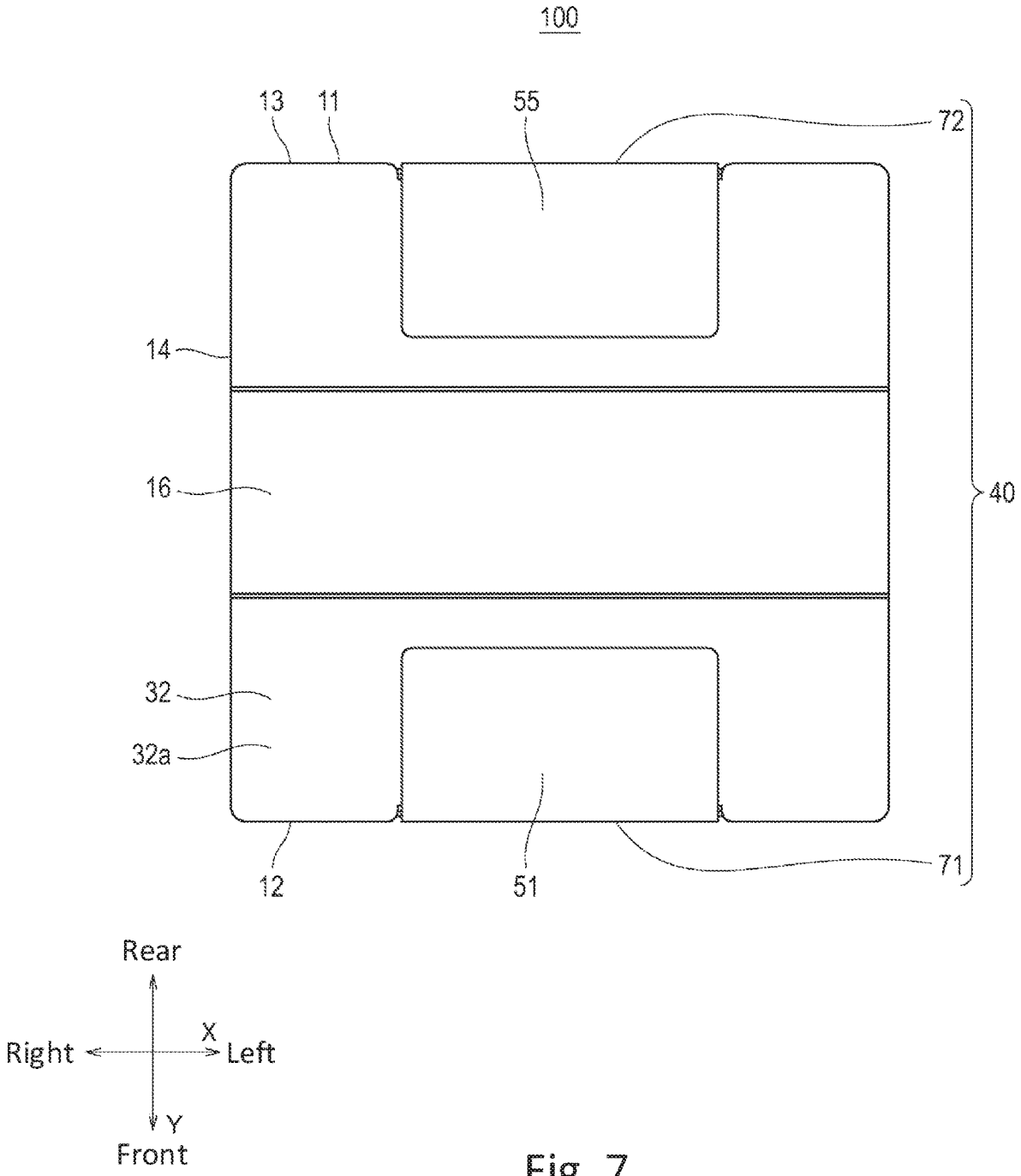
FIG. 7 is a bottom view that shows the inductor according to the first embodiment of the present invention.

As shown in FIGS. 2 and 5, a groove 28 is formed in the top surface 15 of the first core member 11 and extends from a front end to a rear end of the top surface 15 of the first core member 11 along the Y-direction. The groove 28 has a straight part 29 and a pair of front and rear wide parts 30. Specifically, the straight part 29 linearly extends in the front-rear direction (Y-direction). The pair of front and rear wide parts 30 continuously extend from the front and rear ends of the straight part 29 and are wider in the left-right direction (X-direction) than the straight part 29. In each of the wide parts 30, a border region thereof with respect to the straight part 29 becomes wider in width and is taper-shaped at both sides as it becomes far from the straight part 29. On the whole, the groove 28 is formed at a uniform depth. A bottom surface 28*a* of the groove 28 is, on the whole, flat, and at the same time, is horizontal.

However, it is preferred that a chamfer shape (truncation or corner-cut) part 29*b* is formed at the boundary between the bottom surface of the wide part 30 and a first recessed part 31 that is explained below. As shown in FIG. 4B, as an example, the chamfer shape part 29*b* is formed in a step shape of one step. Specifically, for instance, the chamfer shape part 29*b* that is formed at the boundary between the wide part 30 on its front side and the first recessed part 31 on its front side has a tilted surface and a horizontal (level) surface. The tilted surface is downwardly inclined from a front edge of the bottom surface of the wide part 30 toward the front side. The horizontal surface continuously extends from a front edge of the tilted surface. A front edge of the horizontal surface is connected to an upper edge of a bottom surface 31*a* of the first recessed part 31 on the front side. Similarly, for instance, the chamfer shape part 29*b* that is formed at a boundary between the wide part 30 on a rear side and the first recessed part 31 on a rear side has a tilted surface and a horizontal surface. The tilted surface is downwardly inclined from a rear edge of the bottom surface of the wide part 30 toward the rear side. The horizontal surface continuously extends from a rear edge of the tilted surface. A rear edge of the horizontal surface is connected to an upper edge of the bottom surface 31*a* of the first recessed part 31 on the rear side. Therefore, a front edge of the groove 28 is connected to the upper edge of the first recessed part 31 of the front surface 12. At the same time, a rear edge of the groove 28 is connected to the upper edge of the first recessed part 31 of the rear surface 13. However, the chamfer shape (truncation or corner-cut) part 29*b* is not limited to the step shape explained above and can be formed in an arcuate shape.

Further, a non-groove-formed region (a part that is not downwardly recessed and that is not formed with the groove 28) on the top surface 15 of the first core member 11 is referred to as "a first junction (bonding or fixing) region 17." On the top surface 15 of the first core member 11, the first junction region(s) 17 is a pair of left and right regions sandwiching the groove 28. The pair of left and right regions is formed to be flat and horizontally arranged. The first junction regions 17 on the left and right sides are set to have the same lateral width dimension. The bottom surface 26 of the second core member 21 that is opposed to (face) the first junction regions 17 on the left and right sides of the first core member 11 is a second junction region 27. As explained below, because each of the first junction regions 17 is joined to a corresponding second junction region 27, the first core member 11 and the second core member 21 are integrated with each other so as to form the magnetic core 10.

The first recessed part 31 that is inwardly (backwardly) recessed is formed on the front surface 12 of the first core member 11. The first recessed part 31 that is inwardly (forwardly) recessed is formed on the rear surface 13 of the first core member 11 (refer to FIGS. 2 and 4A). On the whole, a depth (a dimension in the front-rear direction) of each of the first recessed parts 31 is uniform. Therefore, the bottom surface 31*a* of the first recessed part 31 on the front side is orthogonal to the Y-direction, and at the same time, is a vertical plane that faces the front side. The bottom surface 31*a* of the first recessed part 31 on the rear side is orthogonal to the Y-direction, and at the same time, is a vertical plane that faces the rear side. Further, the depth of each of the first recessed parts 31 is smaller than a depth of the groove 28. The first recessed part 31 on the front side is formed by extending from the front edge of the groove 28 to a lower edge of the front surface 12. Similarly, the first recessed part 31 on the rear side is formed by extending from the rear edge of the groove 28 to a lower edge of the rear surface 13. Each of the first recessed parts 31 is formed in a rectangular shape. The upper and lower edges of each of the first recessed parts 31 horizontally extend in the left-right direction (X-direction). The left and right sides of each of the first recessed parts 31 vertically extend in the up-and-down direction (Z-direction).

Further, a second recessed part 32 that is upwardly recessed is formed at each of front and rear parts of the bottom surface 16 of the first core member 11. For instance, each of the second recessed parts 32 is formed with a uniform width in the front-rear direction and extends along an entirety of the bottom surface 16 in the lateral (left-right) direction along the front edge or rear edge of the bottom surface 16. On the whole, a depth of each of the second recessed parts 32 is uniform. As a result, a bottom surface 32*a* of each of the second recessed parts 32 is, on the whole, formed to be flat and horizontally arranged. Further, the depth of each of the second recessed parts 32 is smaller than the depth of each of the first recessed parts 31.

The first junction region(s) 17 of the first core member 11 and the second junction region(s) 27 of the second core member 21 are adjacent to each other and are arranged in parallel to each other. For instance, one or both of an adhesive tape 90 and an adhesive is interposed between the first junction regions 17 and the second junction regions 27 (refer to FIGS. 4A and 6). The first junction regions 17 and the second junction regions 27 are surface-joined to each other by one or both the adhesive tape 90 and the adhesive.

By using one or both of the adhesive tape 90 and the adhesive, a gap between the first core member 11 and the second core member 21 is formed, and at the same time, the gap is controlled. As an example of the adhesive tape 90, a Kapton® tape can be used (Kapton® is a registered trademark of DuPont Electronics, Inc.).

In the present embodiment, as shown in FIG. 2, the conductor member 40 is configured with a first (monolithic) metallic member 71 and a second (monolithic) metallic member 72. Each of the first metallic member 71 and the second metallic member 72 is, for instance, a plate-like (malleable) metallic member (metallic plate) of such as a copper plate. The first metallic member 71 has the insertion first sub part (first part) 42, the first outer surface arrangement part 45, the first terminal part 51, and a boundary part (a third boundary part: the details will be explained below). Specifically, the boundary part 63 is interposed between the insertion first sub part 42 and the first outer surface arrangement part 45. Further, the second metallic member 72 has the insertion second sub part (second part) 43, the second outer surface arrangement part 46, the second terminal part 55, and a boundary part 62 (a second boundary part: the details will be explained below). Specifically, the boundary part 62 is interposed between the insertion second sub part 43 and the second outer surface arrangement part 46. In the present embodiment, each of the first metallic member 71 and the second metallic member 72 is a plate member.

The plate of the first metallic member 71 is bent at a boundary between the boundary part 63 and the first outer surface arrangement part 45 (for instance, is bent at 90 degrees). Further, the plate of the first metallic member 71 is also bent at a boundary between the first outer surface arrangement part 45 and the first terminal part 51 (for instance, is bent at 90 degrees). As a result, the insertion first sub part 42 and the boundary part 63 are arranged on the substantially same plane. The insertion first sub part 42 and the boundary part 63 are orthogonal to the first outer surface arrangement part 45, and at the same time, are arranged in parallel to the first terminal part 51. Similarly, the plate of the second metallic member 72 is bent at a boundary between the boundary part 62 and the second outer surface arrangement part 46 (for instance, is bent at 90 degrees). Further, the plate of the second metallic member 72 is also bent at a boundary between the second outer surface arrangement part 46 and the second terminal part 55 (for instance, is bent at 90 degrees). As a result, the insertion second sub part 43 and the boundary part 62 are arranged on the substantially same plane. The insertion second sub part 43 and the boundary part 62 are orthogonal to the second outer surface arrangement part 46, and at the same time, are arranged in parallel to the second terminal part 55.

As explained above, in the present embodiment, the insertion first sub part 42 and the first outer surface arrangement part 45 are parts of the first metallic member 71 that is bent. The insertion second sub part 43 is configured by the second metallic member 72. Further, the insertion second sub part 43 and the second outer surface arrangement part 46 are parts of the second metallic member 72 that is bent. Specifically, the insertion first sub part 42 and the boundary part 63, the first outer surface arrangement part 45, and the first terminal part 51 are parts of the first metallic member 71 that is bent (at two positions). Further, the insertion second sub part 43 and the boundary part 62, the second outer surface arrangement part 46, and the second terminal part 55 are parts of the second metallic member 72 that is bent (at two positions).

In the present embodiment, the first metallic member 71 and the second metallic member 72 are respectively installed on and joined to the first core member 11.

With respect to the first metallic member 71, the insertion first sub part 42 and the boundary part 63 except for a front edge part of the boundary part 63 are stored (accommodated) in the groove 28 and are horizontally arranged along the bottom surface 28*a* of the groove 28. The front edge part of the boundary part 63 is stored (accommodated) in the boundary part between the groove 28 and the first recessed part 31 on the front side. The first outer surface arrangement part 45 of the first metallic member 71 is vertically arranged along the bottom surface 31*a* of the first recessed part 31 on the front side. It is preferred that an entirety of the first outer surface arrangement part 45 is stored (accommodated) in the first recessed part 31 on the front side. The first terminal part 51 of the first metallic member 71 is horizontally arranged along the bottom surface 32*a* of the second recessed part 32 on the front side.

With respect to the second metallic member 72, the insertion second sub part 43 and the boundary part 62 except for a rear edge part of the boundary part 62 are stored (accommodated) in the groove 28. The rear edge part of the boundary part 62 is stored (accommodated) in the boundary part between the groove 28 and the first recessed part 31 on the rear side. The insertion second sub part 43 is arranged so as to be stacked on the insertion first sub part 42 and the boundary part 63. The boundary part 62 is arranged so as to be stacked on the insertion part 41. The insertion second sub part 43 and the boundary part 62 are horizontally arranged. The second outer surface arrangement part 46 of the second metallic member 72 is vertically arranged along the bottom surface 31*a* of the first recessed part 31 on the rear side. It is preferred that an entirety of the second outer surface arrangement part 46 is stored (accommodated) in the first recessed part 31 on the rear side. The second terminal part 55 of the second metallic member 72 is horizontally arranged along the bottom surface 32*a* of the second recessed part 32 on the rear side.

For instance, an entirety of the first metallic member 71 is formed to have a uniform thickness. Similarly, for instance, an entirety of the second metallic member 72 is formed to have a uniform thickness. Further, for instance, the first metallic member 71 and the second metallic member 72 are formed to have the same thickness each other. Therefore, the (total) thickness T1 (a sum of the thicknesses of the insertion first sub part 42 and the insertion second sub part 43) of the insertion first sub part 42 and the insertion second sub part 43 is larger than each of the thicknesses T2 and T3 of the first outer surface arrangement part 45 and the second outer surface arrangement part 46.

As explained above, the conductor member 40 has the insertion part 41 that is inserted into the magnetic core 10. The insertion part 41 is configured with the insertion first sub part 42 and the insertion second sub part 43 that is arranged so as to be stacked on the insertion first sub part 42. In the present embodiment, the insertion part 41 has a double-layer structure of the insertion first sub part 42 and the insertion second sub part 43. However, the present invention is not limited to this structure. The insertion part 41 may have a multilayer structure having three or more layers.

In the present embodiment, each of the insertion first sub part 42 and the insertion second sub part 43 is formed in an elongated plate shape extending in the front-rear direction. The thickness direction thereof is in the vertical (up-and-down) direction. However, the present invention is not limited to this feature. The insertion first sub part 42 and the insertion second sub part 43 may be in a block shape. For instance, the thickness dimensions of the insertion first sub part 42 and the insertion second sub part 43 are the same each other. However, the present invention is not limited to this feature. The thickness dimensions of the insertion first sub part 42 and the insertion second sub part 43 may be different from each other. The thickness dimension of the insertion first sub part 42 may be larger than the thickness dimension of the insertion second sub part 43. On the contrary, the thickness dimension of the insertion second sub part 43 may be larger than the thickness dimension of the insertion first sub part 42.

For instance, the insertion first sub part 42 is formed in a substantially rectangular elongated shape in the front-rear direction in a plan view. The insertion first sub part 42 is formed to be flat and horizontally arranged. For instance, the insertion first sub part 42 has a top surface 42*a* and a bottom surface 42*b*. Specifically, the top surface 42*a* faces the bottom surface 26 of the second core member 21. The bottom surface 42*b* faces the bottom surface 28*a* of the groove 28. The insertion second sub part 43 is formed in a substantially rectangular elongated shape in the front-rear direction in the plan view. The insertion second sub part 43 is formed to be flat and horizontally arranged. For instance, the insertion second sub part 43 has a top surface 43*a* and a bottom surface 43*b*. Specifically, the top surface 43*a* faces the bottom surface 26 of the second core member 21. The bottom surface 43*b* faces the top surface 42*a* of the insertion first sub part 42.

As shown in FIGS. 2 and 5, the conductor member 40 has the boundary part 63 (the third boundary part) and the boundary part 62 (the second boundary part). Specifically, the boundary part 63 is interposed between the insertion first sub part 42 and the first outer surface arrangement part 45 and becomes wider in width as it becomes far from a side of the insertion first sub part 42 toward a side of the first outer surface arrangement part 45. The boundary part 62 is interposed between the insertion second sub part 43 and the second outer surface arrangement part 46 and becomes wider in width as it becomes far from a side of the insertion second sub part 43 toward a side of the second outer surface arrangement part 46.

The boundary part 63 is connected to the front edge of the insertion first sub part 42 and extends forward from this front edge. The lateral (left-right) width dimension of the boundary part 63 becomes wider in width as it becomes far from the front edge of the insertion first sub part 42 and the boundary part 63 is taper-shaped at both sides in the plan view. The front edge part of the boundary part 63 is connected to the upper edge of the first outer surface arrangement part 45.

For instance, the boundary part 63 is formed to be substantially flat and horizontally arranged except for the front edge part. The front edge part of the boundary part 63 is curved to be in an arcuate shape (a projecting arcuate shape upward on the front side). A lower edge of the front edge part is connected to the upper edge of the first outer surface arrangement part 45.

The top and bottom surfaces of the boundary part 63 except for the front edge part continuously extend from and are flush (coplanar) with the top surface 42*a* and the bottom surface 42*b* of the insertion first sub part 42, respectively.

The lateral (left-right) width dimension of the front edge of the boundary part 63 is the same as the lateral (left-right) width dimension of the first outer surface arrangement part 45. Further, the lateral (left-right) width dimension of a rear edge of the boundary part 63 is the same as the lateral (left-right) width dimension of the insertion first sub part 42.

The boundary part 62 is connected to the rear edge of the insertion second sub part 43 and extends backward from this rear edge. The lateral (left-right) width dimension of the boundary part 62 becomes wider in width as it becomes far from the rear edge of the insertion second sub part 43 and the boundary part 62 is taper-shaped at both sides in the plan view. The rear edge part of the boundary part 62 is connected to the upper edge of the second outer surface arrangement part 46.

For instance, the boundary part 62 is formed to be substantially flat and horizontally arranged except for the rear edge part. The rear edge part of the boundary part 62 is curved to be in an arcuate shape (a projecting arcuate shape upward on the rear side). A lower edge of the rear edge part is connected to the upper edge of the second outer surface arrangement part 46.

The top and bottom surfaces of the boundary part 62 except for the rear edge part continuously extend from and are flush (coplanar) with the top surface 43*a* and the bottom surface 43*b* of the insertion second sub part 43, respectively.

The lateral (left-right) width dimension of the rear edge of the boundary part 62 is the same as the lateral (left-right) width dimension of the second outer surface arrangement part 46. Further, the lateral (left-right) width dimension of a front edge of the boundary part 62 is the same as the lateral (left-right) width dimension of the insertion second sub part 43.

Figure 4A:
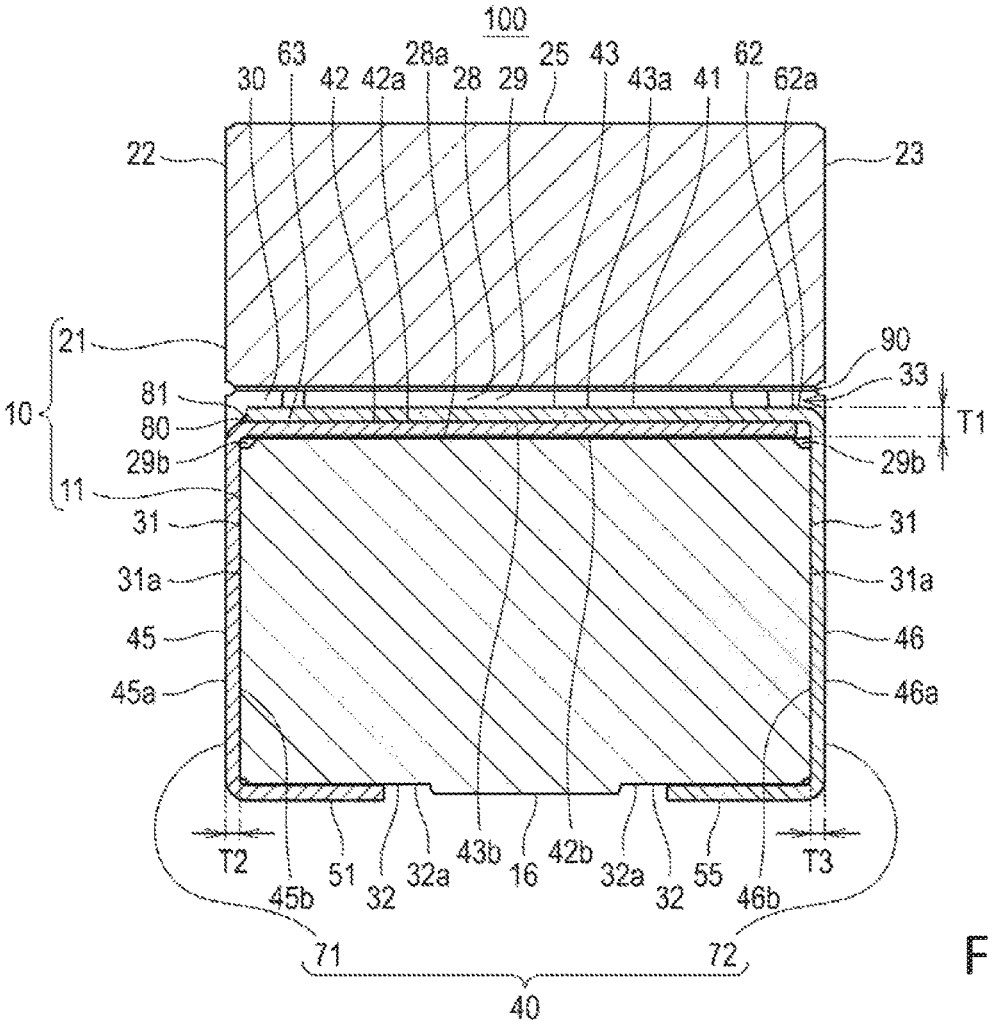
FIG. 4A is a side cross-sectional view (a cross-sectional view along the A-A line shown in FIG. 5) that shows the inductor according to the first embodiment of the present invention.
Figure 4B:
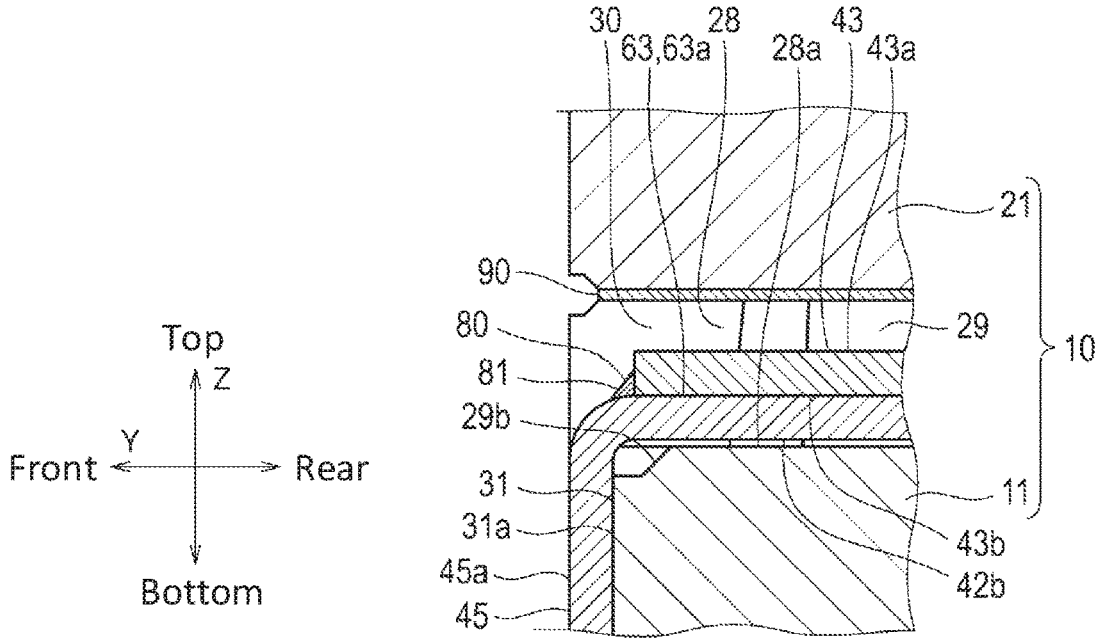
FIG. 4B is a partial enlarged view that shows the inductor shown in FIG. 4A.

As shown in FIGS. 4A, 4B and 5, the bottom surface 42*b* of the insertion first sub part 42 is arranged along the bottom surface 28*a* (for instance, in a state in which the bottom surface 42*b* is in surface contact with the bottom surface 28*a*) of the groove 28. The bottom surface of the boundary part 63 except for the front edge part is arranged along the bottom surface 28*a* (for instance, in a state in which the bottom surface is in surface contact with the bottom surface 28*a*) of the groove 28. Specifically, the insertion first sub part 42 is arranged along the bottom surface of the straight part 29 and the bottom surface of the wide part 30 on the rear side of the groove 28. The boundary part 63 is arranged along the bottom surface of the wide part 30 on the front side. It is preferred that the bottom surface 42*b* of the insertion first sub part 42 and the bottom surface of the boundary part 63 are in surface contact with the bottom surface 28*a* of the groove 28.

The insertion second sub part 43 except for the front end part is arranged so as to be stacked on the insertion first sub part 42. The front end part of the insertion second sub part 43 is arranged so as to be stacked on the boundary part 63. The bottom surface 43*b* of the insertion second sub part 43 is arranged along the top surface 42*a* of the insertion first sub part 42 and a top surface 63*a* of the boundary part 63 (for instance, in a state in which the bottom surface 43*b* is in surface contact with the top surface 42*a* and the top surface 63*a*). The boundary part 62 is arranged so as to be stacked on a rear end part of the top surface 42*a* of the insertion first sub part 42. The boundary part 62 is arranged along the top surface 42*a* of the insertion first sub part 42 (for instance, in a state in which the boundary part 62 is in surface contact with the top surface 42*a* of the insertion first sub part 42).

As explained above, a part of the insertion second sub part 43 is overlapped with the boundary part 63. As a result, because a total cross section area (a sum of a cross section area of the boundary part 63 and a cross section area of the insertion second sub part 43) of the conductor member 40 at the overlapping part can be sufficiently secured, the DC resistance of the conductor member 40 can be more certainly reduced. Further, the boundary part 62 is overlapped with a part of the insertion first sub part 42. As a result, because a total cross section area (a sum of a cross section area of the boundary part 62 and a cross section area of the insertion first sub part 42) of the conductor member 40 at the overlapping part can be sufficiently secured, the DC resistance of the conductor member 40 can be more certainly reduced.

It is preferred that the front edge of the insertion second sub part 43 is arranged behind (backward of) the front surface 12 of the first core member 11 in the Y-direction. It is preferred that the front edge of the boundary part 63 is arranged behind (backward of) the front surface 12 of the first core member 11 in the front-rear direction (Y-direction) or arranged at the same position as the front surface 12. It is preferred that the rear edge of the insertion first sub part 42 is arranged ahead of (forward) the rear surface 13 of the first core member 11 in the Y-direction. It is preferred that the rear edge of the boundary part 62 is arranged ahead of (forward) the rear surface 13 of the first core member 11 in the front-rear direction (Y-direction) or is arranged at the same position as the rear surface 13.

In the present embodiment, a vertical dimension (depth) of the groove 28 is equal to or larger than the total value (the thickness T1) of the thicknesses of the insertion first sub part 42 and the insertion second sub part 43. Specifically, the vertical dimension (the depth) of the groove 28 is larger the thickness T1. Therefore, the positions (heights) of the top surface 43*a* of the insertion second sub part 43 and the top surface 62*a* of the boundary part 62 are lower than the positions (heights) of the first junction regions 17. As a result, a gap 33 (See FIGS. 4A and 6) is formed between the top surface 43*a* of the insertion second sub part 43 and the bottom surface 26 of the second core member 21.

The insertion second sub part 43 is integrated with the insertion first sub part 42 via an electric conductive bonding (joining) material (as an example, solder). In other words, the insertion second sub part 43 except for the front end part is soldered to the top surface 42*a* of the insertion first sub part 42. The front end part of the insertion second sub part 43 is soldered to the top surface 63*a* of the boundary part 63. In the present embodiment, an entirety of the insertion second sub part 43 is soldered to the insertion first sub part 42 or the boundary part 63. At the same time, the front part of the boundary part 62 is soldered to the insertion first sub part 42. Specifically, as shown in FIG. 5, the solder 80 is applied in a state in which a solder fillet 81 is formed along an entire area of the outline of the insertion second sub part 43 and the left and right outlines of the front end part of the boundary part 62 in the plan view.

It is preferred that the solder 80 is not exposed (is not running over) ahead of (forward) the front surface 12 of the first core member 11. The solder 80 may be solder cream that is applied to the entire interface between the insertion first sub part 42 and the insertion second sub part 43. It is preferred that at least both ends of the insertion first sub part 42 and at least both ends of the insertion second sub part 43 are joined (bonded) via the electric conductive bonding material (such as solder). It is more preferred that the entire surface of the insertion first sub part 42 and the entire surface of the insertion second sub part 43 are joined (bonded) via the electric conductive bonding material (such as solder). Further, it is possible that the insertion first sub part 42 and the insertion second sub part 43 are integrated with each other by other methods, such as a resistance welding and a brazing instead of the electric conductive bonding material.

In the present embodiment, a width (in the X-direction) of the insertion second sub part 43 is narrower than a width (in the X-direction) of the insertion first sub part 42. In other words, a lateral (left-right) width dimension W2 (See FIG. 5) of the insertion second sub part 43 is smaller than a lateral (left-right) width dimension W1 (See FIG. 5) of the insertion first sub part 42. At this time, a width dimension of the insertion part 41 corresponds to the lateral (left-right) width dimension W1 of the insertion first sub part 42. According to the configuration explained above, when the insertion second sub part 43 is soldered to the insertion first sub part 42, it is possible to easily confirm whether the solder fillet 81 (refer to FIG. 5) is properly formed around the insertion second sub part 43 or not. Further, the lateral width dimension W1 of the insertion first sub part 42 is set to be slightly smaller than the lateral width dimension of the groove 28.

In the present embodiment, the first outer surface arrangement part 45 is connected to the insertion first sub part 42 via the boundary part 63 (the third boundary part). At the same time, the second outer surface arrangement part 46 is connected to the insertion second sub part 43 via the boundary part 62 (the second boundary part). However, the present invention is not limited to these features. The first outer surface arrangement part 45 may be directly connected to the insertion first sub part 42 (without intervening the boundary part 63). Further, the second outer surface arrangement part 46 may be directly connected to the insertion second sub part 43 (without intervening the boundary part 62). In the present embodiment, the first outer surface arrangement part 45 is arranged along the front surface 12 of the first core member 11. The second outer surface arrangement part 46 is arranged along the rear surface 13 of the first core member 11.

Figure 3A:
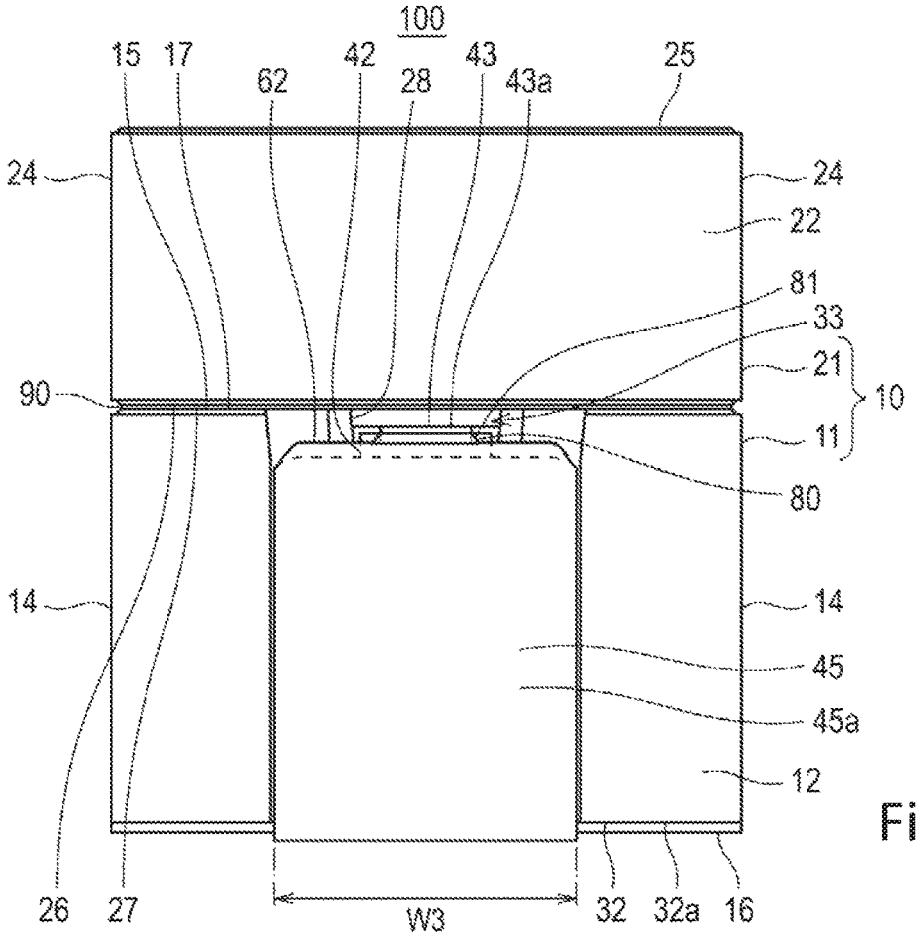
FIGS. 3A and 3B are diagrams that show the inductor according to the first embodiment of the present invention. Specifically.
Figure 3B:
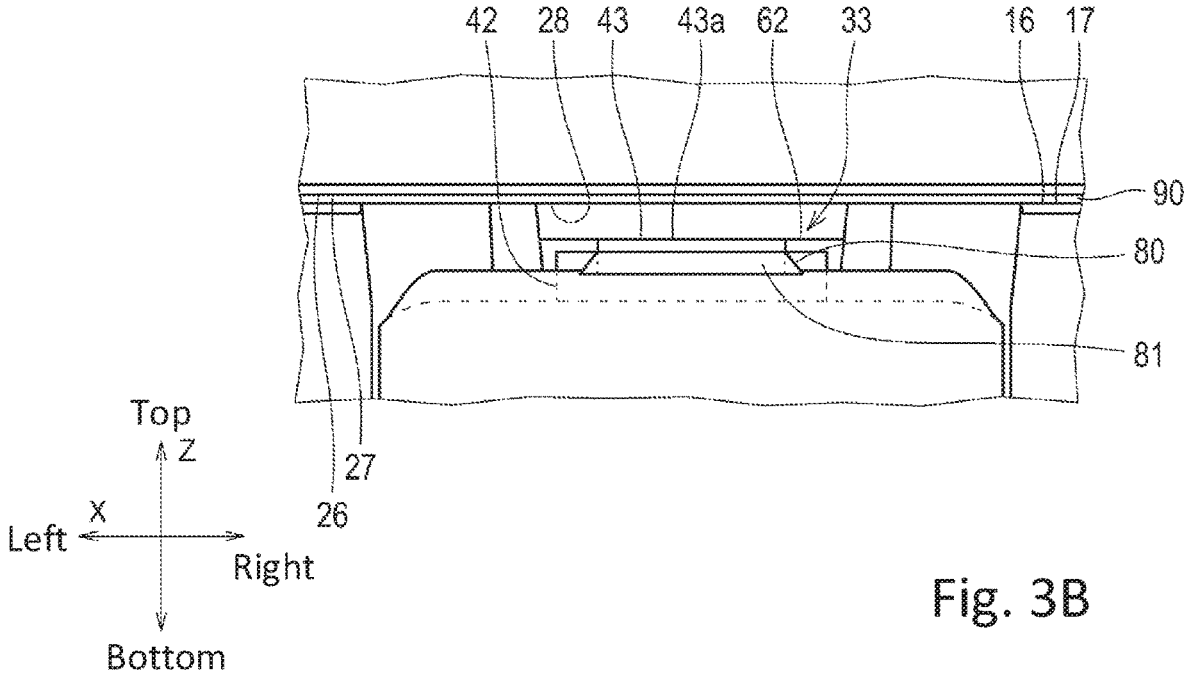

The first outer surface arrangement part 45 is formed to be in a flat plate shape. Further, the plane surfaces of the first outer surface arrangement part 45 face the front-rear directions (forward and backward). The first outer surface arrangement part 45 is formed to be in a rectangular shape in a front view. The upper and lower edges thereof horizontally extend and both the left and right side edges thereof vertically extend. As shown in FIGS. 3A and 4A, the first outer surface arrangement part 45 has an inner surface 45*b* and an outer surface 45*a*. Specifically, the inner surface 45*b* faces the bottom surface 31*a* of the first recessed part 31 on the front side. Thus, the inner surface 45*b* and the bottom surface 31*a* are parallel to each other. The outer surface 45*a* is located opposite to the inner surface 45*b*. More specifically, a position (height) of the upper edge of the first outer surface arrangement part 45 is the same as a position (height) of the upper edge of the bottom surface 31*a* of the first recessed part 31 on the front side. At the same time, a position (height) of the lower edge of the first outer surface arrangement part 45 is the same as a position (height) of the lower edge of the bottom surface 31*a* of the first recessed part 31 on the front side. Both left and right side edges (extending in the Z-direction) of the first outer surface arrangement part 45 are arranged along both left and right side edges (extending in the Z-direction) of the first recessed part 31 on the front side.

In the same manner as the first outer surface arrangement part 45, the second outer surface arrangement part 46 is formed to be in a flat plate shape. Further, the plate surfaces of the second outer surface arrangement part 46 face the front-rear directions (forward and backward). The second outer surface arrangement part 46 is formed to be in a rectangular shape in a front view. The upper and lower edges thereof horizontally extend and both left and right side edges thereof vertically extend. The second outer surface arrangement part 46 has an inner surface 46*b* and an outer surface 46*a*. Specifically, the inner surface 46*b* faces the bottom surface 31*a* of the first recessed part 31 on the rear side. Thus, the inner surface 46*b* and the bottom surface 31*a* are parallel to each other. The outer surface 46*a* is located opposite to the inner surface 46*b*. More specifically, a position (height) of the upper edge of the second outer surface arrangement part 46 is arranged above a position (height) of the upper edge of the bottom surface 31*a* of the first recessed part 31 on the rear side. At the same time, a position (height) of the lower edge of the second outer surface arrangement part 46 is the same as a position (height) of the lower edge of the bottom surface 31*a* of the first recessed part 31 on the rear side. Both left and right side edges (extending in the Z-direction) of the second outer surface arrangement part 46 are arranged along both left and right side edges (extending in the Z-direction) of the first recessed part 31 on the rear side.

For instance, the lateral (left-right) width dimension (in the X-direction) of the first outer surface arrangement part 45 is set to be the same as the lateral (left-right) width dimension (in the X-direction) of the second outer surface arrangement part 46. In the following explanations, the lateral (left-right) width dimension of each of the first outer surface arrangement part 45 and the second outer surface arrangement part 46 is sometimes referred to as "a width dimension W3" (See FIG. 3A). Further, as shown in FIG. 4A, for instance, the vertical (up-and-down) dimension (in the Z-direction) of the second outer surface arrangement part 46 is larger than the vertical (up-and-down) dimension (in the Z-direction) of the first outer surface arrangement part 45 by the thickness of the insertion first sub part 42.

In the present embodiment, the first outer surface arrangement part 45 and the second outer surface arrangement part 46 are adhered to and fixed to the different outer surfaces of the magnetic core 10, respectively. Specifically, the inner surface 45*b* of the first outer surface arrangement part 45 is adhered to and fixed (is surface-joined) to the bottom surface 31*a* of the first recessed part 31 on the front side. At the same time, the inner surface 46*b* of the second outer surface arrangement part 46 is adhered to and fixed (is surface-joined) to the bottom surface 31*a* of the first recessed part 31 on the rear side. As a result, the first outer surface arrangement part 45 and the second outer surface arrangement part 46 can be more stably held by the magnetic core 10.

In the present embodiment, each of the first outer surface arrangement part 45 and the second outer surface arrangement part 46 is formed to be wider than the insertion part 41. The lateral (left-right) width dimension W3 (See FIG. 3) of each of the first outer surface arrangement part 45 and the second outer surface arrangement part 46 is larger than the lateral (left-right) width dimension W1 (See FIG. 5) of the insertion first sub part 42 that is wider than the insertion second sub part 43. Further, it is preferred that the lateral width dimension W3 is set to be two times or more and four times or less than the lateral width dimension W1 or the lateral width dimension W2.

As a result, because cross section areas of the first outer surface arrangement part 45 and the second outer surface arrangement part 46 can be sufficiently secured, the DC resistance of the first outer surface arrangement part 45 and the second outer surface arrangement part 46 can be reduced. Further, a structural strength of the first outer surface arrangement part 45 and the second outer surface arrangement part 46 can be sufficiently secured. In addition, the adhesive areas between the first outer surface arrangement part 45 and the second outer surface arrangement part 46 and the outer surfaces of the magnetic core 10 can be sufficiently secured.

More specifically, the minimum value of the width dimension (the lateral (left-right) width dimension W3) of the first outer surface arrangement part 45 is equal to or more than a sum (the total value) of the minimum value of the width dimension (the lateral (left-right) width dimension W1) of the insertion first sub part 42 and the minimum value of the width dimension (the lateral (left-right) width dimension W2) of the insertion second sub part 43. Note that the term "minimum value" means that the shortest left-right width is used for the comparisons with other (shortest) widths because each value of W1, W2, and W3 may be vary slightly due to manufacturing errors. As a result, because the DC resistance of the first outer surface arrangement part 45 cannot be more than the DC resistance of the insertion part 41, the DC resistance of the conductor member 40 can be more sufficiently reduced.

Similarly, the minimum value of the width dimension (the lateral (left-right) width dimension W3) of the second outer surface arrangement part 46 is equal to or more than a sum (the total value) of the minimum value of the width dimension (the lateral (left-right) width dimension W1) of the insertion first sub part 42 and the minimum value of the width dimension (the lateral (left-right) width dimension W2) of the insertion second sub part 43. As a result, because the DC resistance of the second outer surface arrangement part 46 cannot be more than the DC resistance of the insertion part 41, the DC resistance of the conductor member 40 can be more sufficiently reduced.

Further, the structural strength of the first outer surface arrangement part 45 and the second outer surface arrangement part 46 can be more sufficiently secured. In addition, the adhesive areas between the first outer surface arrangement part 45 and the second outer surface arrangement part 46 and the outer surfaces of the magnetic core 10 can be more sufficiently secured.

Further, it is preferred that the minimum value of the width dimension (the lateral (left-right) width dimension W3) of the first outer surface arrangement part 45 is the same as the sum (the total value) of the minimum value of the width dimension (the lateral (left-right) width dimension W1) of the insertion first sub part 42 and the minimum value of the width dimension (the lateral (left-right) width dimension W2) of the insertion second sub part 43. Similarly, it is preferred that the minimum value of the width dimension (the lateral (left-right) width dimension W3) of the second outer surface arrangement part 46 is the same as the sum (the total value) of the minimum value of the width dimension (the lateral (left-right) width dimension W1) of the insertion first sub part 42 and the minimum value of the width dimension (the lateral (left-right) width dimension W2) of the insertion second sub part 43.

The lateral width dimension W3 (in the X-direction) of the first outer surface arrangement part 45 is slightly smaller than the lateral width dimension (in the X-direction) of the bottom surface 31*a* of the first recessed part 31 on the front side. In the front-rear direction (Y-direction), it is preferred that the outer surface 45*a* of the first outer surface arrangement part 45 is positioned at the same position as the front surface 12 of the first core member 11 or is positioned behind (backward) the front surface 12. In the present embodiment, in the front-rear direction, the outer surface 45*a* of the first outer surface arrangement part 45 and the front surface 12 of the first core member 11 are positioned at the same position (the outer surface 45*a* and the front surface 12 are coplanar with each other). The first outer surface arrangement part 45 is arranged so as to cover (overlap) an area from the upper end to the lower end of the bottom surface 31*a* of the first recessed part 31 on the front side in the front view.

Similarly, the lateral width dimension W3 (in the X-direction) of the second outer surface arrangement part 46 is slightly smaller than the lateral width dimension (in the X-direction) of the bottom surface 31*a* of the first recessed part 31 on the rear side. In the front-rear direction, it is preferred that the outer surface 46*a* of the second outer surface arrangement part 46 is positioned at the same position as the rear surface 13 of the first core member 11 or is positioned ahead of (forward) the rear surface 13. In the present embodiment, in the front-rear direction, the outer surface 46*a* of the second outer surface arrangement part 46 and the rear surface 13 of the first core member 11 are positioned at the same position (the outer surface 46*a* and the rear surface 13 are coplanar with each other). The second outer surface arrangement part 46 is arranged so as to cover (overlap) an area from the upper end to the lower end of the bottom surface 31*a* of the first recessed part 31 on the rear side in the front view.

As shown in FIG. 2, the first terminal part 51 is connected to the lower edge of the first outer surface arrangement part 45. The first terminal part 51 extends backward from the lower edge of the first outer surface arrangement part 45. Similarly, the second terminal part 55 is connected to the lower edge of the second outer surface arrangement part 46. The second terminal part 55 extends forward from the lower edge of the second outer surface arrangement part 46. Each of the first terminal part 51 and the second terminal part 55 is formed in a flat plate shape and is horizontally arranged. A planar shape of each of the first terminal part 51 and the second terminal part 55 is not particularly limited. However, the planar shape is, for instance, a rectangular shape.

A top surface of the first terminal part 51 faces the bottom surface 32*a* of the second recessed part 32 on the front side. Further, the top surface of the first terminal part 51 is close to or in contact (is in surface contact) with the bottom surface 32*a*. For instance, the lateral (left-right) width dimension (in the X-direction) of the first terminal part 51 is set to be the same dimension as the lateral (left-right) width dimension W3 (in the X-direction) of the first outer surface arrangement part 45. For instance, the boundary part between the first terminal part 51 and the first outer surface arrangement part 45 is curved to be in an arcuate shape (a projecting arcuate shape downward on the front side) (refer to FIG. 4A).

A top surface of the second terminal part 55 face the bottom surface 32*a* of the second recessed part 32 on the rear side. Further, the top surface of the second terminal part 55 is close to or in contact (is in surface contact) with the bottom surface 32*a*. For instance, the lateral (left-right) width dimension (in the X-direction) of the second terminal part 55 is set to be the same dimension as the lateral (left-right) width dimension W3 (in the X-direction) of the second outer surface arrangement part 46. For instance, the boundary part between the second terminal part 55 and the second outer surface arrangement part 46 is curved to be in an arcuate shape (a projecting arcuate shape downward on the rear side) (refer to FIG. 4A).

The first terminal part 51 and the second terminal part 55 are arranged at the substantially same height each other. The positions (heights) of the bottom surfaces of the first terminal part 51 and the second terminal part 55 are located lower than the position (height) (the position of the bottom surface 16 where the second recessed part 32 is not formed) of the bottom surface 16 of the first core member 11. As a result, when the inductor 100 is mounted on a substrate or the like (not shown), the interference between the magnetic core 10 and the substrate can be suppressed.

In the present embodiment, the insertion first sub part 42 and the insertion second sub part 43 that are separately formed by the different members are in surface contact with each other so as to be stacked on each other. As a result, the sufficient adhesion between the insertion first sub part 42 and the insertion second sub part 43 can be realized. Therefore, a desired shape or configuration of the insertion part 41 can be obtained easily and accurately. As a result, a manufacturing easiness of the inductor 100 is satisfactory, and at the same time, the inductor 100 that has a stable property can be reproducibly manufactured.

For instance, an assembly of the inductor 100 can be performed as explained below. First, the first metallic member 71 is installed to the first core member 11. In other words, while the bottom surface 42*b* of the insertion first sub part 42 and the bottom surface of the boundary part 63 are arranged along the bottom surface 28*a* of the groove 28, the inner surface 45*b* of the first outer surface arrangement part 45 is adhered and fixed to the bottom surface 31*a* of the first recessed part 31 on the front side.

Next, the second metallic member 72 is installed to the first core member 11. At the same time, the insertion second sub part 43 of the second metallic member 72 is electrically and mechanically joined (bonded) to the insertion first sub part 42 of the first metallic member 71. In other words, while the bottom surface 43*b* of the insertion second sub part 43 and the bottom surface of the boundary part 62 are arranged along the top surface 63*a* of the boundary part 63 and the top surface 42*a* of the insertion first sub part 42, the inner surface 46*b* of the second outer surface arrangement part 46 is adhered and fixed to the bottom surface 31*a* of the first recessed part 31 on the rear side. Further, the insertion second sub part 43 is joined to the insertion first sub part 42 by using the electric conductive bonding material (for instance, the solder 80). However, the method for joining (bonding) the insertion second sub part 43 to the insertion first sub part 42 is not limited to the soldering. Another method, such as welding (such as a resistance welding and a laser welding), can also be used.

The bending at the boundary between the first outer surface arrangement part 45 and the first terminal part 51 may be performed before the first metallic member 71 is installed to the first core member 11 or may be performed after the first metallic member 71 is installed to the first core member 11. Similarly, the bending at the boundary between the second outer surface arrangement part 46 and the second terminal part 55 may be performed before the second metallic member 72 is installed to the first core member 11 or may be performed after the second metallic member 72 is installed to the first core member 11.

Further, the insertion part 41 is configured by the stacked structure of the insertion first sub part 42 and the insertion second sub part 43. Thus, although the thickness of each of the first metallic member 71 and the second metallic member 72 becomes thinner (smaller), the insertion part 41 can have the sufficient cross section area. Therefore, the DC resistance of the conductor member 40 can be sufficiently reduced, and at the same time, the first metallic member 71 and the second metallic member 72 can be easily bent (with a light force). As a result, when the first metallic member 71 and the second metallic member 72 are bent in a state in which the first metallic member 71 and the second metallic member 72 have been fixed (installed) to the first core member 11, the stress acting on the first core 11 can be reduced.

Next, the second core member 21 is attached on the first core 11. Specifically, the first junction region(s) 17 of the first core member 11 is fixed to the second junction regions 27 of the second core member 21 via either one or both of the adhesive tape 90 and the bonding (joining) material. Accordingly, the inductor 100 of the present embodiment can be obtained.

Variation of First Embodiment

Next, a variation of the first embodiment according to the present invention will be explained with reference to FIG. 8 below.

In the present embodiment (variation), a middle part (a part that is located between both ends of the insertion second sub part 43) of the insertion second sub part 43 in the front-rear direction (Y-direction) is locally formed to be wider in width. In the following explanation, the part that is locally formed to be wider in width is referred to as "a wide part 43*c*." Specifically, for instance, the wide part 43*c* extends toward the left and right sides as compared with the other parts of the insertion second sub part 43 in which the wide part 43*c* is not formed.

With respect to the wide part 43*c*, a planar shape of a projecting part(s) that extends toward the left and right sides as compared with the other parts of the insertion second sub part 43, in which the wide part 43*c* is not formed, is not particularly limited. However, for instance, as shown in FIG. 8, the planar shape can be in a rectangular shape that has a longer dimension in the front-rear direction (Y-direction). For instance, an entirety of the insertion second sub part 43 including the wide part 43*c* is formed to have a uniform thickness.

Even in the present embodiment (variation), the insertion second sub part 43 is integrated with the insertion first sub part 42 via the electric conductive bonding material (as an example, the solder 80). For instance, as shown in FIG. 8, the solder is applied so that the solder fillet 81 is formed along the entire periphery of the insertion second sub part 43 except for both left and right side edges of the wide part 43*c* in the plan view.

Because the insertion second sub part 43 has the wide part 43*c*, the second metallic member 72 that has the insertion second sub part 43 and the first metallic member 71 that does not have the insertion second sub part 43 can be more easily recognized.

Figure 8:
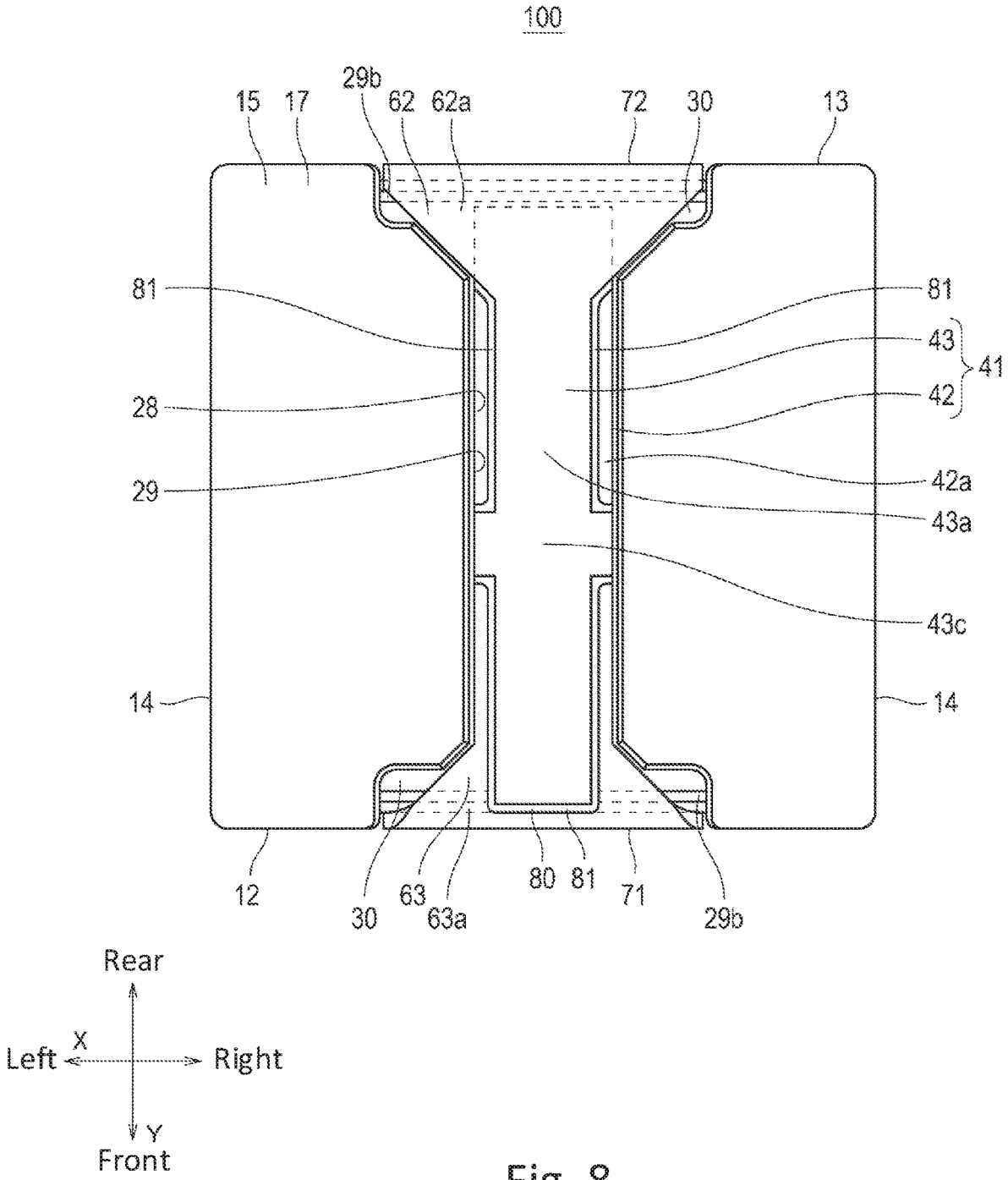
FIG. 8 is a plan view that shows an inductor according to a variation of the first embodiment of the present invention (however, an illustration that shows a second core member is omitted).

As shown in FIG. 8, it is preferred that the lateral (left-right) width dimension (in the X-direction) of the wide part 43*c* is slightly smaller than the lateral (left-right) width dimension (in the X-direction) of the straight part 29 of the groove 28. According to the configuration describe above, when the insertion second sub part 43 having the wide part 43*c* is arranged within the straight part 29 of the groove 28, the second metallic member 72 can be perfectly and easily arranged at a center position of the straight part 29 of the groove 28 in the left-right direction (in the X-direction). Further, a displacement or shifting of the second metallic member 72 in the left-right directions (along the X-direction) relative to the straight part 29 can be suppressed.

Second Embodiment

Next, a second embodiment according to the present invention will be explained with reference to FIGS. 9-12 below. An inductor 100 according to the second embodiment of the present invention is different from the inductor 100 according to the first embodiment of the present invention with respect to features that are explained below. The other features (the same features as the inductor 100 according to the first embodiment) of the inductor 100 according to the second embodiment are configured in the same way as the inductor 100 according to the first embodiment of the present invention that is explained above.

Figure 9:
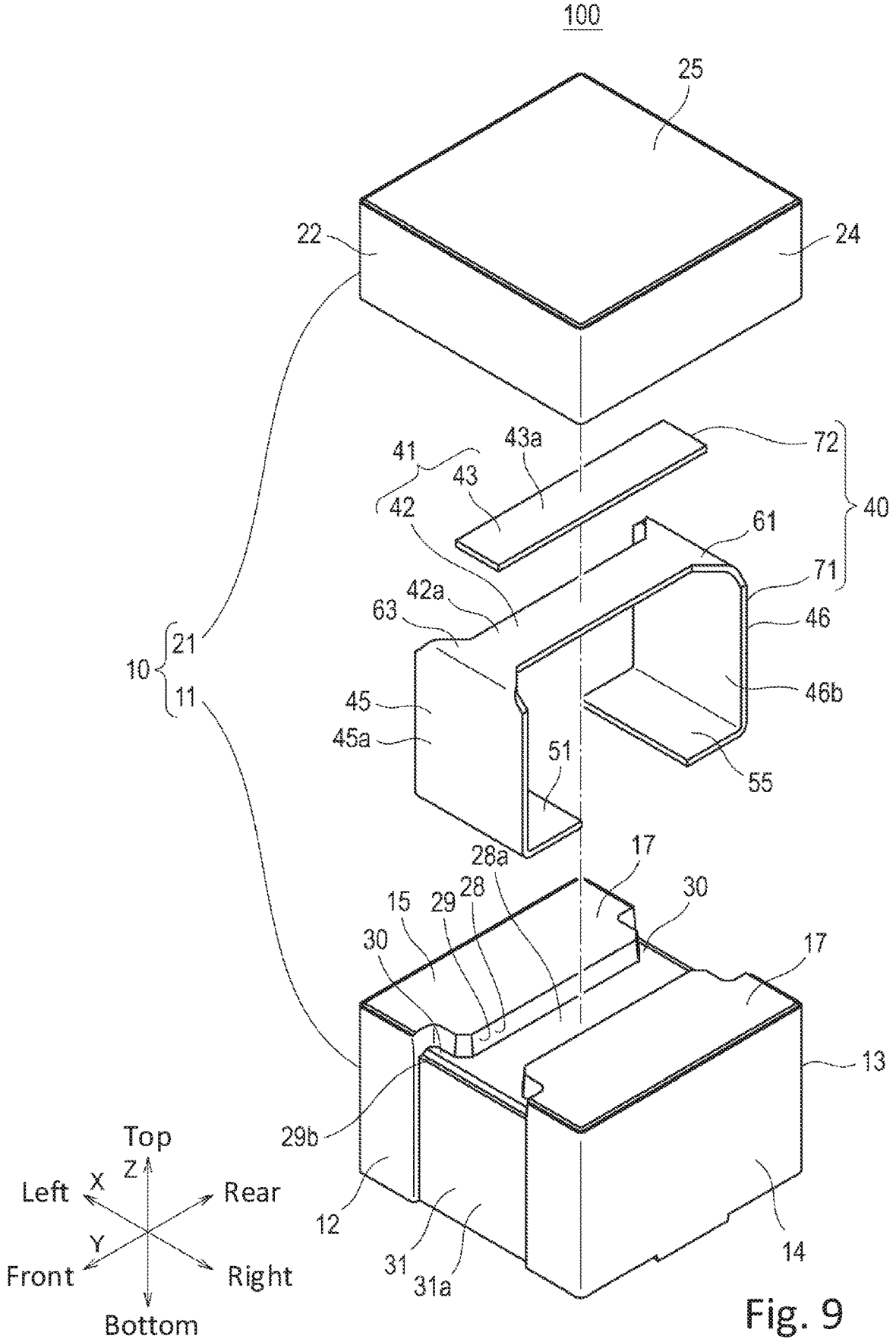
FIG. 9 is an exploded perspective view that shows an inductor according to a second embodiment of the present invention.
Figure 10:
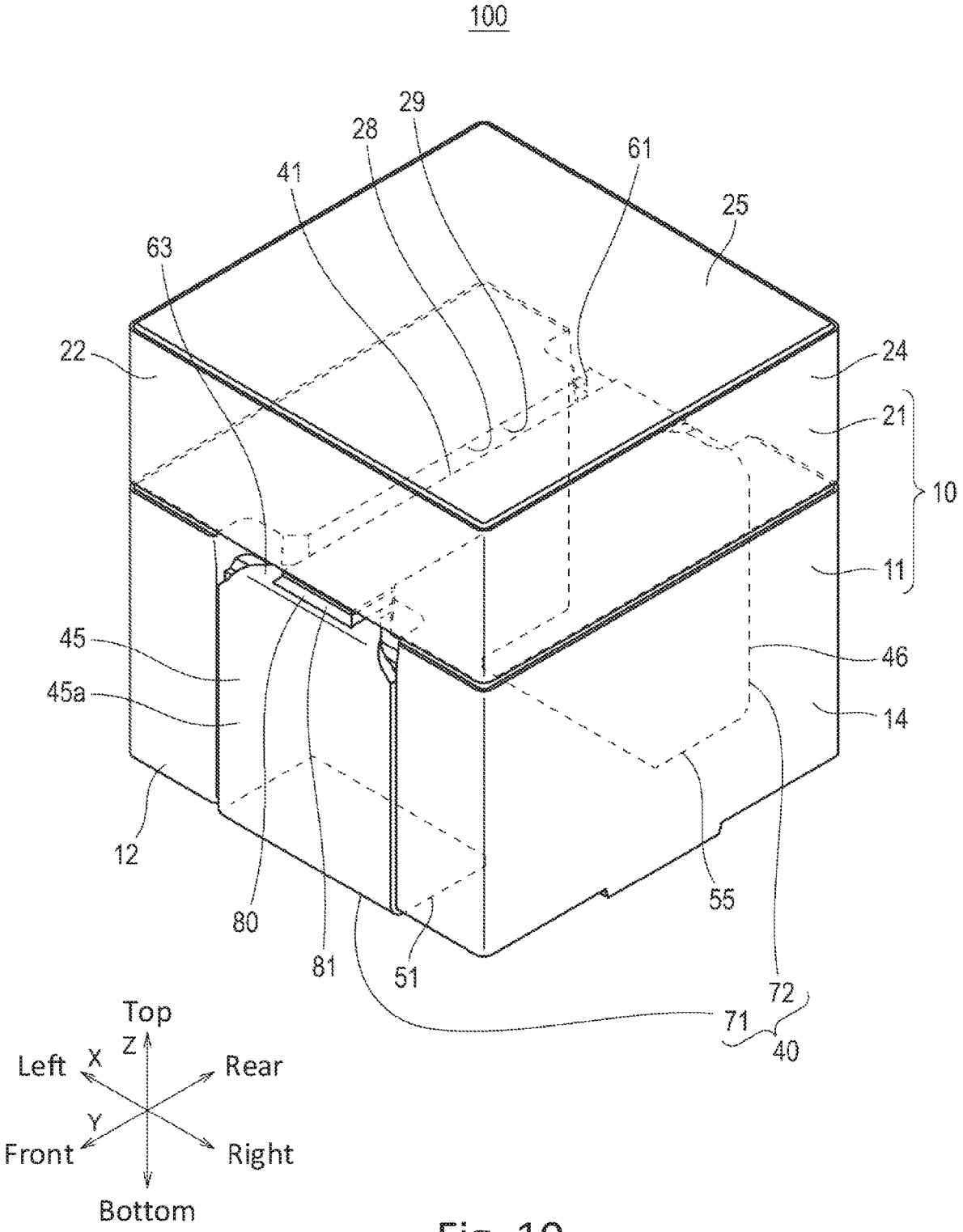
FIG. 10 is a perspective view that shows the inductor according to the second embodiment of the present invention.

As shown in FIG. 9, in the present embodiment, the second metallic member 72 does not have the boundary part 62, the second outer surface arrangement part 46, and the second terminal part 55 unlike the first embodiment. The second metallic member 72 is configured by only the insertion second sub part 43. Therefore, in the present embodiment, a planar shape of the second metallic member 72 is a rectangular shape and extends in the front-rear direction (the Y-direction).

On the other hand, the first metallic member 71 is configured with a boundary part 61 (a first boundary part), the second outer surface arrangement part 46, and the second terminal part 55 in addition to the insertion first sub part 42, the boundary part 63, the first outer surface arrangement part 45, and the first terminal part 51 in the same manner as the first embodiment. In other words, the second outer surface arrangement part 46 is configured by a part of the first metallic member 71. Further, in the present embodiment, vertical dimensions (in the Z-direction) of the first outer surface arrangement part 45 and the second outer surface arrangement part 46 are the same.

The boundary part 61 is interposed between the insertion first sub part 42 and the second outer surface arrangement part 46. Further, the boundary part 61 becomes wider in width as it becomes far from a side of the insertion first sub part 42 toward a side of the second outer surface arrangement part 46. In other words, in the present embodiment, the conductor member 40 includes the boundary part 61 (the first boundary part) that is interposed between the insertion first sub part 42 and the second outer surface arrangement part 46 and becomes wider in width as it becomes far from the side of the insertion first sub part 42 toward the side of the second outer surface arrangement part 46.

The boundary part 61 is connected to the rear edge of the insertion first sub part 42 and extends backward from the rear edge. The lateral (left-right) width dimension (in the X-direction) of the boundary part 61 becomes wider in width toward the rear end and the boundary part 61 is taper-shaped at both sides in the plan view. The rear edge part of the boundary part 61 is connected to the upper edge of the second outer surface arrangement part 46.

For instance, the boundary part 61 except for the rear edge part is formed to be substantially flat and horizontally arranged. The rear edge part of the boundary part 61 is curved to be in an arcuate shape (a projecting arcuate shape upward on the rear side). The lower edge of the rear edge part is connected to the upper edge of the second outer surface arrangement part 46.

Top and bottom surfaces of the boundary part 61 except for the rear edge part are continuously arranged with and coplanar with the top surface 42*a* and the bottom surface 42*b* of the insertion first sub part 42, respectively.

The lateral (left-right) width dimension of the rear edge of the boundary part 61 is the same as the lateral (left-right) width dimension of the second outer surface arrangement part 46. Further, the lateral (left-right) width dimension of the front edge of the boundary part 61 is the same as the lateral (left-right) width dimension of the insertion first sub part 42.

The boundary part 61 except for the rear edge part is stored in the groove 28 and is horizontally arranged along the bottom surface 28*a* of the groove 28 (the bottom surface of the wide part 30 on the rear side). The rear edge part of the boundary part 61 is stored in a boundary part between the groove 28 (the wide part 30 on the rear side) and the first recessed part 31 on the rear side.

Figure 11:
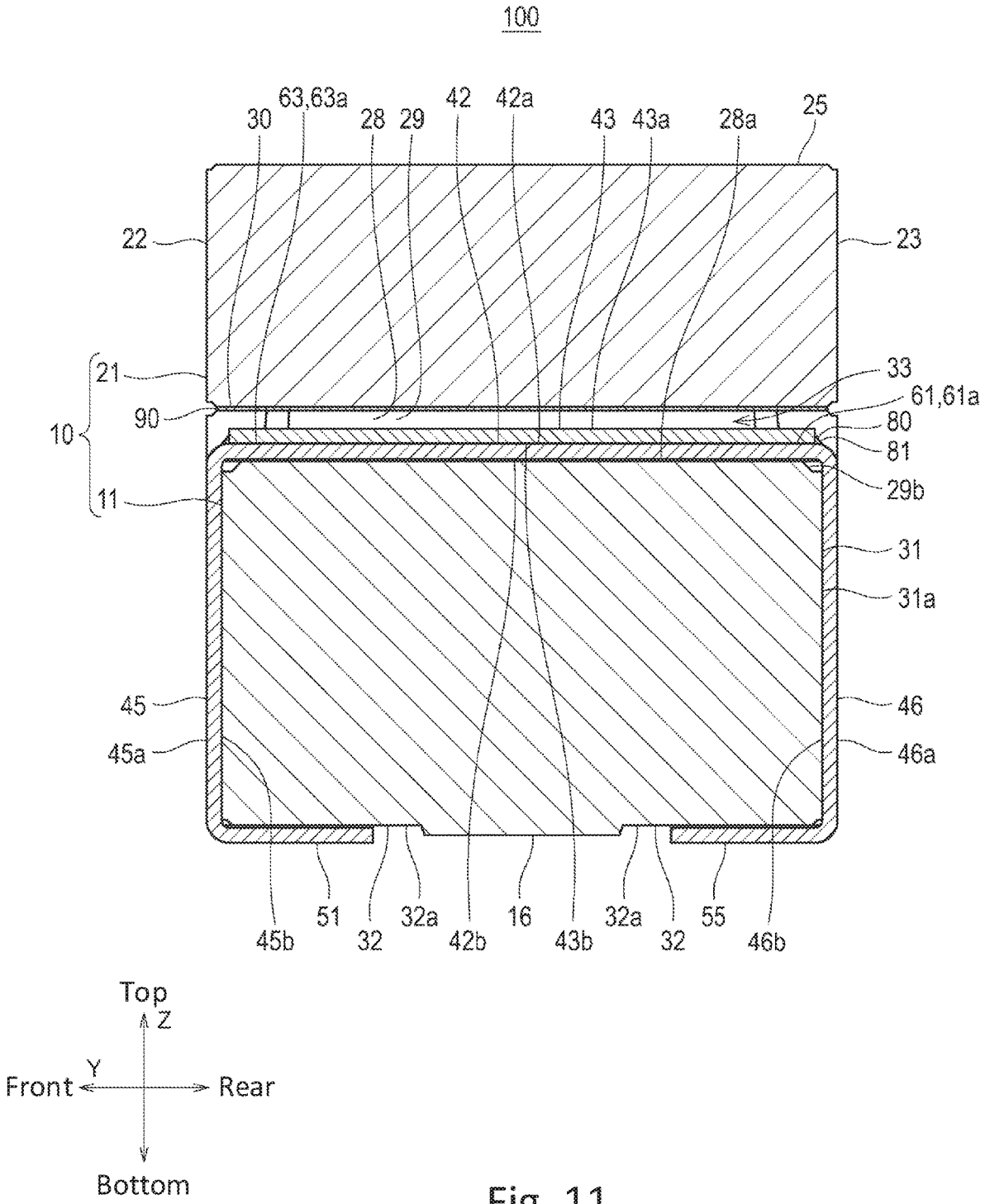
FIG. 11 is a side cross-sectional view that shows the inductor according to the second embodiment of the present invention.

As shown in FIG. 11, in the present embodiment, a part of the insertion second sub part 43 is overlapped with the boundary part 61. Specifically, the bottom surface 43*b* of the insertion second sub part 43 is arranged along the top surface 63*a* of the boundary part 63, the top surface 42*a* of the insertion first sub part 42, and the top surface 61*a* of the boundary part 61.

In the present embodiment, the insertion second sub part 43 is soldered to the insertion first sub part 42 so that the solder fillet 81 is formed along the entire periphery of the insertion second sub part 43 (the second metallic member 72) in the plan view.

For instance, the assembly of the inductor 100 according to the present embodiment can be performed as explained below. First, the first metallic member 71 is installed to the first core member 11. For instance, the first metallic member 71 that is in a flat state is fixed to the first core member 11. Specifically, the insertion first sub part 42 is arranged along the bottom surface 28*a* of the groove 28. Thereafter, the first metallic member 71 is bent at 90 degrees at a boundary between the boundary part 63 and the first outer surface arrangement part 45 and at a boundary between the boundary part 61 and the second outer surface arrangement part 46. Thereafter, the first outer surface arrangement part 45 and the second outer surface arrangement part 46 are arranged along the bottom surfaces 31*a* of the first recessed parts 31 on the front and rear sides, respectively. Further, the first metallic member 71 is bent at 90 degrees at a boundary between the first outer surface arrangement part 45 and the first terminal part 51 and at a boundary between the second outer surface arrangement part 46 and the second terminal part 55. Thereafter, the first terminal part 51 and the second terminal part 55 are arranged along the bottom surfaces 32*a* of the second recessed parts 32 on the front and rear sides, respectively (refer to FIGS. 10 and 11).

With respect to the present embodiment, the insertion part 41 is also configured by the stacked structure of the insertion first sub part 42 and the insertion second sub part 43. Thus, although the thickness of each of the first metallic member 71 and the second metallic member 72 becomes thinner (smaller), the insertion part 41 can have the sufficient cross section area. Therefore, the DC resistance of the conductor member 40 can be sufficiently reduced, and at the same time, the first metallic member 71 and the second metallic member 72 can be easily bent (with a light force). As a result, when the first metallic member 71 and the second metallic member 72 are bent in a state in which the first metallic member 71 and the second metallic member 72 have been fixed (installed) to the first core member 11, the stress acting on the first core 11 can be reduced.

Further, before the first metallic member 71 is fixed (installed) to the first core member 11, the first metallic member 71 may be bent at least one of the boundary between the boundary part 63 and the first outer surface arrangement part 45 and the boundary between the boundary part 61 and the second outer surface arrangement part 46.

Figure 12:
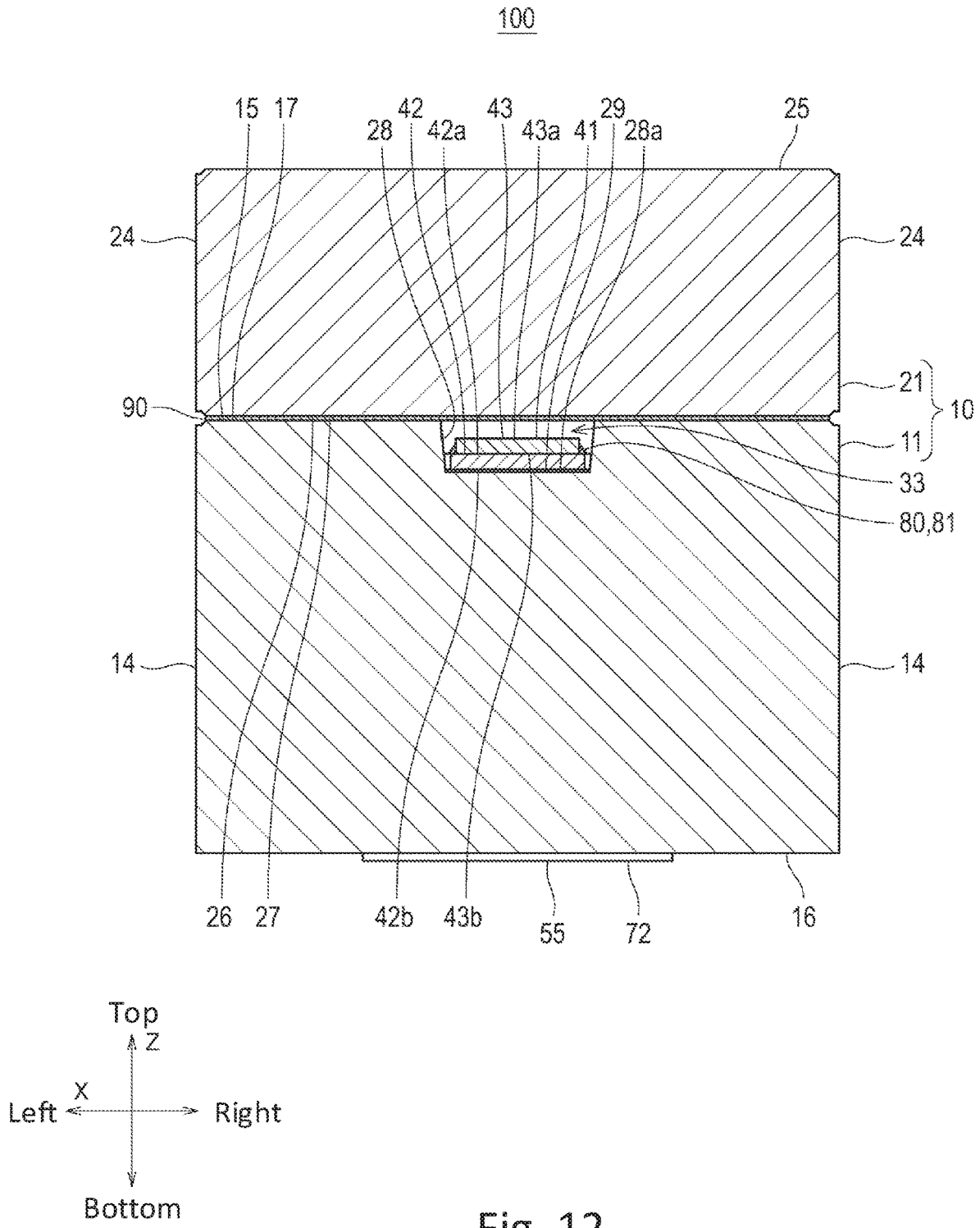
FIG. 12 is a front cross-sectional view that shows the inductor according to the second embodiment of the present invention.

Next, the second metallic member 72 (the insertion second sub part 43) is soldered to the top surface 42*a* of the insertion first sub part 42 (refer to FIGS. 11 and 12).

Next, in the same manner as the first embodiment, the second core member 21 is attached on the first core member 11. Accordingly, the inductor 100 of the present embodiment can be obtained.

Third Embodiment

Next, a third embodiment according to the present invention will be explained with reference to FIG. 13 below. Further, an illustration of the second core member 21 is omitted from FIG. 13. An inductor 100 according to the third embodiment of the present invention is different from the inductor 100 according to the first embodiment of the present invention with respect to features that are explained below. The other features (the same features as the inductor 100 according to the first embodiment) of the inductor 100 according to the third embodiment are configured in the same way as the inductor 100 according to the first embodiment of the present invention that is explained above.

Figure 13:
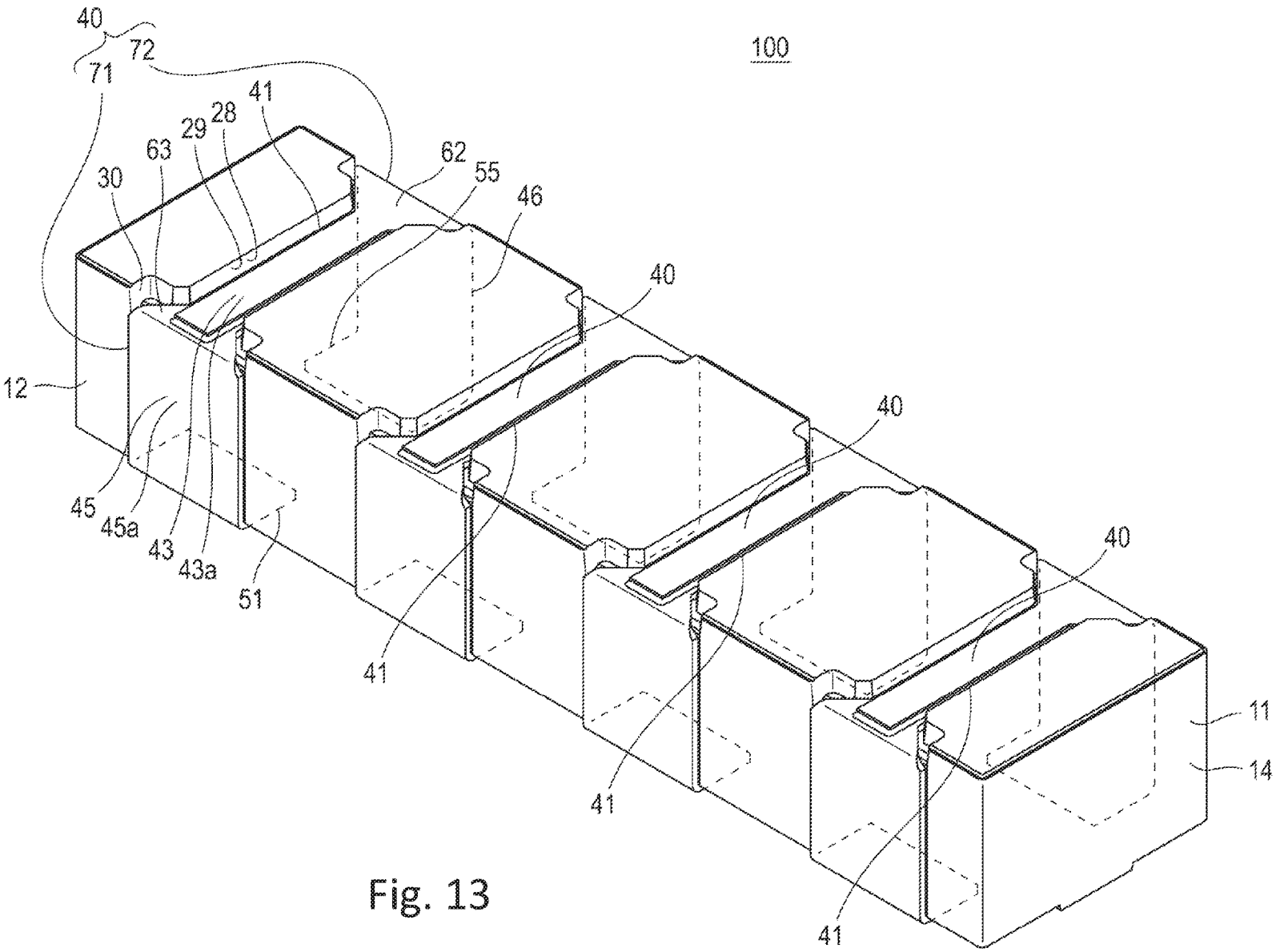
FIG. 13 is a perspective view that shows an inductor according to a third embodiment of the present invention (however, an illustration that shows a second core member is omitted).

As shown in FIG. 13, in the present embodiment, for instance, the inductor 100 is configured by a plurality (for instance, four) of conductor members 40 that are installed (attached) to a single magnetic core (a single first core member 11). Therefore, the inductor 100 is configured by a plurality (for instance, four) of inductor elements. However, the present embodiment is not limited to this feature. The number of inductor elements that the inductor 100 has may be two, three, or five or more.

In the present embodiment, the magnetic core 10 is formed in an elongated shape in the left-right direction as compared with the magnetic core 10 according to the first embodiment. In other words, the magnetic core 10 is formed in an elongated rectangular parallelepiped shape in the left-right direction. Further, the magnetic core 10 has a plurality of groups (for instance, four sets) of the parts that are provided at every predetermined distance (at a predetermined interval) (for instance, at every regular distance) in the left-right direction. Specifically, each group includes the groove 28, the first recessed parts 31 on the front and rear sides, and the second recessed parts 32 on the front and rear sides (refer to the first embodiment). Further, the plurality (four) of conductor members 40 are provided at every predetermined distance (for instance, at every regular interval) in the left-right direction.

Further, in FIG. 13, each of the conductor members 40 has the same configuration as the first embodiment. However, each of the conductor members 40 may have the same configuration as the variation of the first embodiment or the second embodiment.

Each embodiment is explained with reference to the drawings. However, these embodiments (and variation) are examples so that the present invention is not limited to these embodiments. So long as the object of the present invention is achieved, these embodiments may be varied in many ways.

For instance, the insertion part 41 that is configured by two members (the first metallic member 71 and the second metallic member 72) is explained above. However, the present invention is not limited to this feature. The insertion part 41 may have a stacked structure of three or more members. In this case, the total thickness of the insertion part 41 that is configured by the stacked structure with three or more members is larger than each of the thicknesses of the first outer surface arrangement part 45 and the second outer surface arrangement part 46.

Further, in the above embodiments, the magnetic core 10 is formed by the ferrite system magnetic material. However, the present invention is not limited to this feature. The magnetic core 10 may be formed by a metal magnetic material. In this case, the magnetic core 10 may be formed as an integrated magnetic core in which the conductor member 40 is embedded inside the integrated magnetic core 10. Further, in this case, it is preferred that the bonding (joining) between the first metallic member 71 and the second metallic member (the bonding (joining) between the insertion first sub part 42 and the insertion second sub part 43) is performed by a welding (for instance, a resistance welding or a laser welding). As a result, although the magnetic core 10 is exposed with a heat during a pressure molding, the bonding (joining) state between the first metallic member 71 and the second metallic member 72 can be maintained.

Further, in the above embodiments, the thickness dimensions of the first metallic member 71 and the second metallic member 72 are the same. However, the present invention is not limited to this feature. The thickness dimensions of the first metallic member 71 and the second metallic member 72 may be different from each other.

Further, in the above embodiments, the conductor member 40 has the boundary parts (any two of the boundary parts 61, 62, and 63). However, the present invention is not limited to this feature. The conductor member 40 may have no boundary part. In other words, in the first embodiment, the width dimensions of the first metallic member 71 and the second metallic member 72 may suddenly or steeply change at the boundary between the insertion first sub part 42 and the first outer surface arrangement part 45 and at the boundary between the insertion second sub part 43 and the second outer surface arrangement part 46. At the same time, in the second embodiment, the width dimension of the first metallic member 71 may suddenly or steeply change at the boundary between the insertion first sub part 42 and the first outer surface arrangement part 45 and at the boundary between the insertion first sub part 42 and the second outer surface arrangement part 46.

Further, in the above embodiments, the insertion first sub part 42 and the first outer surface arrangement part 45 are different portions of the monolithic metallic member (the first metallic member 71). However, the present invention is not limited to this feature. The first outer surface arrangement part 45 may be separately formed with a different member from the insertion first sub part 42 and may be indirectly electrically (and mechanically) or directly electrically (and mechanically) connected to the insertion first sub part 42. Similarly, in the first embodiment, the insertion second sub part 43 and the second outer surface arrangement part 46 are different portions of the monolithic metallic member (the second metallic member 72). However, the present invention is not limited to this feature. The second outer surface arrangement part 46 may be separately formed with a different member from the insertion second sub part 43 and may be indirectly electrically (and mechanically) or directly electrically (and mechanically) connected to the insertion second sub part 43. Yet similarly, in the second embodiment, the insertion first sub part 42, the first outer surface arrangement part 45, and the second outer surface arrangement part 46 are different portions of the monolithic metallic member (the first metallic member 71). However, the present invention is not limited to this feature. The insertion first sub part 42, the first outer surface arrangement part 45, and the second outer surface arrangement part 46 may be separately formed with three different members and these three separate members may be indirectly electrically (and mechanically) or directly electrically (and mechanically) connected to each other.

Further, in the above embodiments, the groove 28 that stores the insertion part 41 is selectively formed only in the first core member 11 out of the first core member 11 and the second core member 21. However, the present invention is not limited to this feature. The groove 28 may be formed in the bottom surface 26 of the second core member 21, or may be formed in both of the top surface 15 of the first core member 11 and the bottom surface 26 of the second core member 21.

Further, the embodiments of the present invention further include the following technical ideas or technical concepts.

(1) An inductor includes a magnetic core and a conductor member. The conductor member is configured with: an insertion part that is inserted into the magnetic core; a first outer surface arrangement part that is directly or indirectly connected to one end of the insertion part and that is arranged along a first outer surface of the magnetic core; a second outer surface arrangement part that is directly or indirectly connected to the other end of the insertion part and that is arranged along a second outer surface of the magnetic core; a first terminal part that is connected to the first outer surface arrangement part; and a second terminal part that is connected to the second outer surface arrangement part. The insertion part includes an insertion first sub part and an insertion second sub part that is stacked on the insertion first sub part. A sum of the thicknesses of the insertion first and second sub parts is larger than each of a thickness of the first outer surface arrangement part and a thickness of the second outer surface arrangement part.

(2) The inductor according to (1), wherein each of a width of the first outer surface arrangement part and a width of the second outer surface arrangement part is larger than a width of the insertion part.

(3) The inductor according to (2), wherein a minimum value of a width dimension of the first outer surface arrangement part is equal to or larger than a sum of a minimum value of a width dimension of the insertion first sub part and a minimum value of a width dimension of the insertion second sub part.

(4) The inductor according to any of (1)-(3), wherein the insertion second sub part is integrated with the insertion first sub part via a conductive bonding material.

(5) The inductor according to (4), wherein a width of the insertion second sub part is smaller than a width of the insertion first sub part.

(6) The inductor according to (5), wherein a center part of the insertion second sub part in a longitudinal direction thereof is wider than other parts of the insertion second sub part.

(7) The inductor according to any of (1)-(6), wherein the insertion first sub part and the first outer surface arrangement part are parts of a first monolithic metallic member that is bent, and the insertion second sub part is configured by a second monolithic metallic member.

(8) The inductor according to (7), wherein the second outer surface arrangement part is a part of the first monolithic metallic member.

(9) The inductor according to (7) or (8), wherein the conductor member further includes a first boundary part, the first boundary part intervenes between the insertion first sub part and the second outer surface arrangement part, and widths of the first boundary part taper off toward the insertion first sub part, and the insertion second sub part is partially stacked on the first boundary part.

(10) The inductor according to (7), wherein the insertion second sub part and the second outer surface arrangement part are parts of the second monolithic metallic member that is bent.

(11) The inductor according to (10), wherein the first outer surface arrangement part and the second outer surface arrangement part are adhered and fixed to the first outer surface and the second outer surface of the magnetic core, respectively.

(12) The inductor according to (10) or (11), wherein the conductor member further includes a second boundary part, the second boundary part intervenes between the insertion second sub part and the second outer surface arrangement part, and widths of the second boundary part taper off toward the insertion second sub part, and the second boundary part is stacked on a part of the insertion first sub part.

(13) The inductor according to any of (7)-(12), wherein the conductor member further includes a third boundary part, the third boundary part intervenes between the insertion first sub part and the first outer surface arrangement part, and widths of the third boundary part taper off toward the insertion first sub part, and the insertion second sub part is partially stacked on the third boundary part.

The inductor being thus described, it will be apparent that the same may be varied in many ways. Such variations are not to be regarded as a departure from the spirit and scope of the invention, and all such modifications as would be apparent to one of ordinary skill in the art are intended to be included within the scope of the following claims. Further, the above embodiments can be combined with each other and such combinations are not to be regarded as a departure from the spirit and scope of the invention.

What is claimed is:

1. An inductor comprising:

a magnetic core; and a conductor member, the conductor member being configured with:

an insertion part that is inserted into the magnetic core;

a first outer surface arrangement part that is connected to one end of the insertion part and that is arranged along a first outer surface of the magnetic core;

a second outer surface arrangement part that is connected to the other end of the insertion part and that is arranged along a second outer surface of the magnetic core;

a first terminal part that is connected to the first outer surface arrangement part; and a second terminal part that is connected to the second outer surface arrangement part;

wherein the insertion part includes an insertion first sub part and an insertion second sub part that is stacked on the insertion first sub part, and each of the insertion first sub part and the insertion second sub part is formed of metal, at least both ends of the insertion first sub part and at least both ends of the insertion second sub part are joined via a conductive bonding material, and a sum of a thickness of the insertion first sub part and a thickness of the insertion second sub part is larger than a thickness of the first outer surface arrangement part and larger than a thickness of the second outer surface arrangement part.

2. The inductor according to claim 1, wherein a width of the first outer surface arrangement part and a width of the second outer surface arrangement part are both larger than a width of the insertion part.

3. The inductor according to claim 2, wherein a minimum width of the first outer surface arrangement part is equal to or larger than a sum of a minimum width of the insertion first sub part and a minimum width of the insertion second sub part.

4. The inductor according to claim 3, wherein the insertion first sub part and the first outer surface arrangement part are parts of a first monolithic metallic member that is bent, and the insertion second sub part is configured by a second monolithic metallic member.

5. The inductor according to claim 2, wherein the insertion first sub part and the first outer surface arrangement part are parts of a first monolithic metallic member that is bent, and the insertion second sub part is configured by a second monolithic metallic member.

6. The inductor according to claim 1, wherein the insertion first sub part and the first outer surface arrangement part are parts of a first monolithic metallic member that is bent, and the insertion second sub part is configured by a second monolithic metallic member.

7. The inductor according to claim 6, wherein the second outer surface arrangement part is a part of the first monolithic metallic member.

8. The inductor according to claim 7, wherein the conductor member further includes a first boundary part, the first boundary part intervenes between the insertion first sub part and the second outer surface arrangement part, and a width of the first boundary part tapers toward the insertion first sub part, and the insertion second sub part is partially stacked on the first boundary part.

9. The inductor according to claim 6, wherein the conductor member further includes a first boundary part, the first boundary part intervenes between the insertion first sub part and the second outer surface arrangement part, and a width of the first boundary part tapers toward the insertion first sub part, and the insertion second sub part is partially stacked on the first boundary part.

10. The inductor according to claim 6, wherein the insertion second sub part and the second outer surface arrangement part are parts of the second monolithic metallic member that is bent.

11. The inductor according to claim 10, wherein the first outer surface arrangement part and the second outer surface arrangement part are adhered and fixed to the first outer surface and the second outer surface of the magnetic core, respectively.

12. The inductor according to claim 11, wherein the conductor member further includes a second boundary part, the second boundary part intervenes between the insertion second sub part and the second outer surface arrangement part, and a width of the second boundary part tapers toward the insertion second sub part, and the second boundary part is stacked on a part of the insertion first sub part.

13. The inductor according to claim 10, wherein the conductor member further includes a second boundary part, the second boundary part intervenes between the insertion second sub part and the second outer surface arrangement part, and a width of the second boundary part tapers toward the insertion second sub part, and the second boundary part is stacked on a part of the insertion first sub part.

14. The inductor according to claim 13, wherein the conductor member further includes a third boundary part, the third boundary part intervenes between the insertion first sub part and the first outer surface arrangement part, and a width of the third boundary part tapers toward the insertion first sub part, and the insertion second sub part is partially stacked on the third boundary part.

15. The inductor according to claim 6, wherein the conductor member further includes a third boundary part, the third boundary part intervenes between the insertion first sub part and the first outer surface arrangement part, and a width of the third boundary part tapers toward the insertion first sub part, and the insertion second sub part is partially stacked on the third boundary part.

16. The inductor according to claim 1, wherein a width of the insertion second sub part is smaller than a width of the insertion first sub part.

17. The inductor according to claim 16, wherein a center part of the insertion second sub part in a longitudinal direction thereof is wider than other parts of the insertion second sub part.

* * * * *